US005240162A

United States Patent [19]

Block

[11] Patent Number: 5,240,162

[45] Date of Patent: Aug. 31, 1993

[54] TRIGGERLESS TAGGING SYSTEM

[76] Inventor: Charles Block, 1129 Albert Rd., North Bellmore, N.Y. 11710

[21] Appl. No.: 840,244

[22] Filed: Feb. 24, 1992

Related U.S. Application Data

[63] Continuation-in-part of Ser. No. 579,917, Sep. 7, 1990, Pat. No. 5,090,490.

[51] Int. Cl.[5] ..... B25B 33/00

[52] U.S. Cl. ..... 227/130; 74/89.22; 173/170; 227/67; 227/156

[58] Field of Search ..... 227/67, 68, 71, 130, 227/156; 91/47; 454/340; 173/170; 74/89.22

[56] References Cited

U.S. PATENT DOCUMENTS 1,758,781 5/1907 Burger et al. ..... 30/250
3,084,672 4/1963 Dalton ..... 91/47 X
3,598,025 8/1971 Cotton ..... 227/67 X
3,937,216 2/1976 Brown ..... 602/32
4,782,746 11/1988 Niccolls ..... 99/535 X

*Primary Examiner*—Frank T. Yost
*Assistant Examiner*—Kenneth E. Peterson
*Attorney, Agent, or Firm*—Paul J. Sutton

[57] ABSTRACT

The present invention teaches a powered tagging system in the forms of either a power attachment for an existing tagger, or a complete powered tagger. This invention virtually eliminates problems associated with carpal tunnel syndrome in users by providing actuating means other than those requiring conventional triggering hand muscles. Means are provided which shield otherwise conventional triggering means. A lightweight, compact, yet powerful power system is provided within a balanced assembly capable of manipulation in one hand. In a preferred embodiment, either hand can be used and no finger pressure is required to activate the system.

12 Claims, 11 Drawing Sheets

FIG. 12
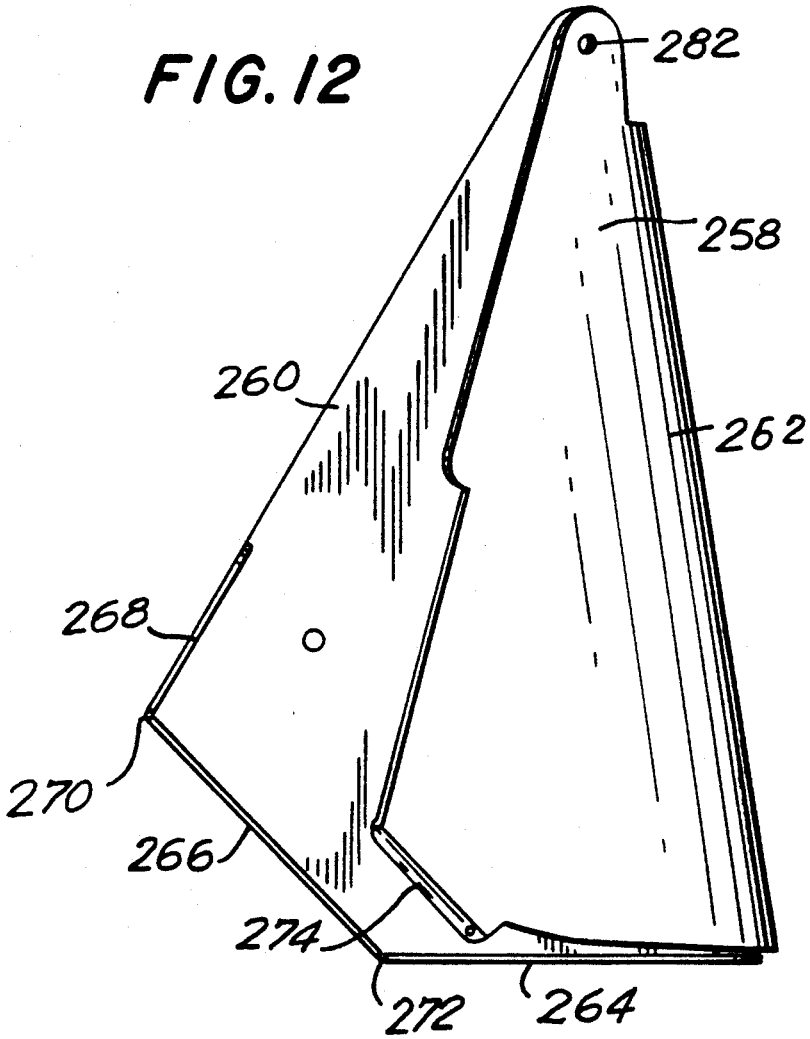
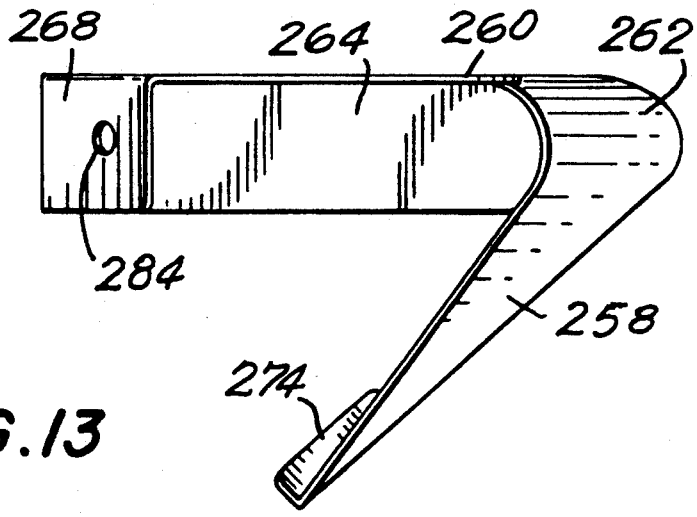
FIG. 13

TRIGGERLESS TAGGING SYSTEM

This application is a continuation-in-part of pending U.S. application Ser. No. 07/579,917 filed Sep. 7, 1990, now U.S. Pat. No. 5,090,490.

BACKGROUND OF THE INVENTION

1. Field of the Invention

The present invention relates to improvements in hand tools and more particularly it relates to an improved powered actuator system for trigger-operated hand tools. Still more particularly, but without limitation, the invention is concerned with providing an improved powered actuator system which is suitable for use with hand-held tagging tools or other trigger-operated hand tools whose repeated use can strain or injure (temporarily or permanently) the operator's hand.

2. The Prior Art

Lightweight, pistol-like hand tools are widely used to fasten labels to a variety of products. A fastener is ejected from a barrel by means of a large trigger which is typically spring-loaded to provide the energy to drive fasteners out of the barrel. Such hand tools are loosely, but extensively, called "handguns" or "guns".

Plastics-material fasteners having a closable barb at one end, a thin shank and an anchor at the other end, often referred to simply as "barbs", are widely used for attaching price or product-information labels to garments, soft furnishings and many other high-volume consumer products. A standard technique for attaching them involves "firing" or urging the barbs through a price or product label held in front of an attachment point on the garment or other product, by means of a pistol-like hand-held applicator tool which discharges a "collapsed" or closed barb through a hollow needle projecting from the barrel of the applicator. In those instances where the label or tag is pre-punched with a hole, the needle is placed through this hole and the label or tag is held by the operator's forefinger just prior to inserting the needle through the garment layer to which it is to be attached. The barbed end of the fastener penetrates the label and garment, draws the fastener shank through the label and garment, and opens up on the other side of the garment so that the barb cannot be drawn back through the garment. Meanwhile the fastener anchor, which can be a simple T-shaped piece, prevents the shank from passing through the label. In this manner the fastener (sometimes referred to as a barb) is secured to the garment so that its removal leaves visible evidence: usually the barb is severed, and the alternatives are to cut or tear the garment or label.

Typical tagging tools are trigger-operated hand tools of the type having a barrel adapted to lie across an operator's hand, an operating head at one end of the barrel, a hand-grip-and-trigger assembly depending from the barrel and configured to be held in one hand between the fingers and palm thereof so that the tool can be operated by squeezing the trigger, wherein the required squeeze loading is in excess of 2 lb. For tagging with barbs, a hollow applicator needle is mounted in the barrel of the tool and is fed with a skein of barbs, in some instances from a magazine carried on the tool, one barb being fired each time the trigger is pulled. Since the energy driving the barb comes from the operator's hand, significant loading of the trigger is required, and typical actuator forces are in excess of 4 or 6 lb., and commonly range from four to eight pounds only because ten pounds would be too heavy for most operators.

Long-term repetitive use of these tools, as is required for commercial and industrial applications, can cause carpal tunnel syndrome, a disorder of the nervous system in the heel of the hand which may substantially disable the operator's hand. The disablement can often last weeks or months and in severe cases may be permanent. Obviously, there is a need to provide tagging equipment which is not prone to cause such a debilitating syndrome.

To this end the prior art has provided powered actuator systems for trigger-operated hand tools which mount the tool in a stand at a table and in which a power-driven mechanical linkage operates the trigger under the control of a hand or foot switch. These systems can relieve the operator of undue and potentially injurious stresses, but require that the product to be tagged be brought to the tagging table (or vice versa), which restricts the utility of this type of tagging system. In particular, such an immobile or inflexible tagging system is plainly incapable of being easily manipulated for use in tagging boxed or hanging garments.

Hand-held powered tagging tools are known but they tend to be bulky and expensive. These tools also have a variety of designs serving a variety of special needs and duplication of this variety in a range of powered tools would be impractical and costly either for the manufacturer of the equipment or its customers. Furthermore, prior art powered portable tools are heavy and cumbersome.

There is accordingly a need to provide an improved powered actuator system which can overcome the drawbacks of the prior art. Both electric and pneumatic power means have been proposed, but neither has been satisfactorily incorporated in a system that can fulfill the objects of the present invention.

A prior art design which has come to the applicant's attention is the HT-100 device. This design, which makes use of the HT-100 booster shown at the bottom of the page, can be operated by closing port "D" by "finger" pressure instead of by using a hair-trigger valve. However, the leakage rate of wasted air is very high, unless the air pressure is very low. Also, the HT-100 device would still require another valve to operate the cylinder which would thus necessitate a 4-way valve (double-acting cylinder).

BRIEF SUMMARY OF THE INVENTION

It is one object of the present invention to provide an improved powered actuator system attachment for a trigger-operated hand tool, which system is capable of being assembled with hand tools to provide a powered tool assembly which is portable and comfortably maneuverable.

It is another object of this invention to provide such a powered actuator system which can yield a powered tool assembly including a hand tool with a relatively heavy trigger loading that can be operated in a manner which will substantially alleviate or even eliminate significant risk of carpal tunnel syndrome.

Yet another object of this invention is to provide such a system which can provide an assembly including a hand tool with a relatively heavy trigger loading which can be operated substantially without moving the hand's carpal ligaments in the carpal tunnel after the assembly has been gripped.

It is a further object of this invention to provide such a powered actuator system which is compact and lightweight.

It is yet another object of the invention to provide such a system which can be assembled with hand tools to provide a powered tool assembly which can be held, maneuvered and manipulated in substantially the same manner as the hand tool would have been if used alone.

A further object of the invention is to provide such a powered tool assembly which can be operated in one hand, leaving the operator's other hand free for cooperative functions, for example, to position a label and a garment for the label to be attached thereto.

Yet another object of this invention is to provide a powered actuator system whose largest overall dimension, in at least one embodiment is no more than 20 percent greater than that of the tool alone.

A further object of this invention is to provide a mechanism for powering and driving such a system which is sufficiently lightweight and compact to meet some or all of the above objectives.

It is a still further object to provide such a system having power means which is powerful enough properly to actuate the hand tool, yet which is sufficiently lightweight and compact so as to be readily maneuvered without being heavy or unwieldy.

Another object of this invention is to provide such a powered actuator system which is capable of actuating the hand tool repeatedly in such a controlled and consistent manner as to prolong the working life of the tool as compared with the life of like manually operated tools.

Accordingly, one embodiment of the present invention provides a powered actuator system for a trigger-operated hand tool of the type having a self-supporting tool body, an operating head mounted on the tool body and a tool-operating trigger articulated to the tool body to be closable theretowards against resilient return means, which powered actuator system includes a tool-engaging housing or shield extending around the trigger and adapted to be attached to the tool body and to shield the trigger from being depressed, trigger-actuator means for operating the trigger of the hand tool and enabling the resilient return thereof, power means to power said trigger actuator-means, which power means is switchably connectable to a power supply, switch means for controlling actuation of the power means, and support means for said housing, trigger-actuator means and power means, wherein the tool-supporting housing provides grip means for an operator to hold and operate an assembly of the powered actuator system and its associated hand tool in one hand, and wherein said switch means is preferably, but not necessarily, disposed adjacent said grip means so as to be capable of comfortable, repeated operation by the operator's thumb while holding the assembly.

Preferably, the tool-supporting housing substantially encloses the trigger and provides a comfortable finger-grip surface therearound. In the aforementioned embodiment, the system is specifically adapted for a tool having a pistol grip with a handle to which said trigger is articulated and the tool-supporting housing of the powered actuator system extends beneath the handle and trigger to accommodate trigger-actuator means therebeneath.

For enhanced balance and feel, said power means is supported at one side of the handle-and-trigger of the hand tool and opposite the operator's hand. In this embodiment, said housing is fabricated of resilient sheet metal material so as to be relatively lightweight.

In the aforementioned embodiment of this invention, the power means is pneumatic and the powered actuator system is provided with hose means to connect same to a compressed air supply. By virtue of an especially ingenious pneumatic design, the invention provides a surprisingly compact and lightweight, yet powerful power system. Indeed, in this embodiment the powered actuator system has an overall height and breadth which are little more than those of the tool itself, and the assembly, as compared with the tool itself, is less than substantially twenty percent (20%) longer, when viewed in a rearward direction from the operating head. What little additional bulk the powered actuator system provides is preferably disposed generally downwardly of the tool body and away from the work area or engagement zone where the operator's hand is to engage. This engagement zone preferably includes a substantial portion of the original gripping area of the hand tool itself—for example the back of the tool handle may be engaged by the heel or the palm of the operator's hand both in manual operation and in the powered tool assembly.

The trigger actuator means comprises a flexible member connectable between the operating trigger and a drive member connected in turn to said power means and wherein the drive member wraps and releases in a rotary manner a ribbon (serving the function of a flexible belt) connected to the trigger, thereby pulling same into an operating position and releasing it therefrom in response to the aforesaid rotary motion.

In one embodiment, the hand tool trigger has a loading in excess of four pounds and the switch means has a loading less than two pounds.

Preferably, in this embodiment, said switch means is positioned for comfortable operation by an operator's thumb while holding the powered tool assembly, whereby the tool can be operated without significant movement of the operator's carpal tunnel ligaments, once the operator has grasped the powered tool assembly.

In one embodiment of the invention, the entire powered actuator system attachment weighs less than eight ounces so that when used in combination with a hand tool weighing about three ounces, the assembly weighs less than eleven ounces.

In the preferred embodiment, the present invention comprises a powered actuator system for a trigger-operated hand tool of the type having a self-supporting tool body, an operating head mounted on the tool body and a tool-operating trigger articulated to the tool body to be closeable there towards resilient return means, which powered actuated system includes a tool-engaging housing or shield extending around the trigger and adapted to be attached to the tool body and to shield the trigger from being depressed, trigger actuator means for operating the trigger of the hand tool and enabling the resilient return thereof, power means to power the trigger-actuator means, which power means is switchably connectable to a power supply, switch means comprising a spool valve for controlling actuation of the power means, and support means for the housing, trigger-actuator means, and power means, wherein the tool-supporting housing provides grip means for an operator to hold and operate an assembly of the power actuator system and its associated hand tool in either hand, and wherein said switch means is preferably, but not necessarily, disposed adjacent to said grip means so as to be capable of comfortable, repeated operation by an operator's finger while holding the assembly.

Preferably, the tool-supporting housing substantially encloses the trigger and provides a comfortable finger-grip surface therearound. In this embodiment, this system is specifically adapted for a tool having a pistol grip with a handle to which the trigger is articulated and the tool-supporting housing of the powered actuating system extends beneath the handle and trigger to accommodate trigger-actuator means therebeneath.

For enhanced balance of feel in the preferred embodiment, the power means is supported generally below the handle and trigger of the hand tool to facilitate the operator's using the trigger with either hand. In this preferred embodiment, this housing is fabricated with resilient sheet metal so as to be relatively lightweight.

In the preferred embodiment of this invention, the power means is pneumatic, and the powered actuator system is provided with hose or other air line means to connect it to a compressed gas supply. The pneumatic system is designed to be compact and lightweight, yet powerful. The small additional bulk which the powered actuator system provides is preferably disposed generally downwardly from the tool body and away from the work area or engagement zone which the operator's hand contacts. This engagement zone includes a substantial portion of the original gripping area of the hand tool itself, e.g., the back of the tool handle may be engaged by the heel of the palm of the operator's hand both for manual operation and with the powered tool assembly.

The switch means of the preferred embodiment comprises a sensor trigger (bleed port) connected at the front of the powered actuator system attachment for the trigger-operated hand tool, with the pneumatic system generally providing a constant but small stream of air through the open valve which can be capped by an operator's finger to redirect the air stream to operate a valve which in turn, supplies a burst of air to a rotary cylinder which functions as a type of air motor, driving a rotary cylinder to an actuated position for turning a drive shaft and a drum mounted thereon through a considerable rotary angle, e.g., 270 degrees, thereby winding up a ribbon attached to the drum and to the trigger of the tool to actuate the trigger to move toward the front end of the tagging tool and fire a barb or fastener through a label and into a garment. Resilient means in the tagging tool and the piston and cylinder assembly, if desired, together with a return air tube of the compressed air system, restore the powered tool assembly to its inactivated state, thus ready for another firing.

The use of a capped spool valve, which requires very little actuator force since no "0" rings or friction developing seals are present, results in the need for a minimal flow of air being required to operate the spool valve against a spring return.

The preferred embodiment also includes a flow regulator which comprises a clamp on the tubing and a screw for adjusting the clamp whereby the wasted air through the bleed valve can be kept at a minimum.

It can be seen from the above description that the preferred embodiment completely releases the fingers of the operator from having to frequently intermittently oppose the trigger loading, which typically can be 6 to 10 pounds, and even represents a substantial improvement over the aforementioned prior application Ser. No. 07/579,917 of the applicant in not requiring even the fractional amount of pressure exerted by the operator's finger as compared to the required trigger pressure, but instead requires merely that the operator place a finger over the bleed port to effectuate a firing.

The system according to this invention is especially well adapted for use with a tagging tool whose operating head includes a hollow needle for ejecting barbed fasteners through labels and into garments thereby to attach a label to a garment. However, it is intended that the scope of the present invention be broad enough to encompass an actuating system capable of use with several different types of handguns or the like.

The invention extends to a powered tool assembly comprising a powered actuator system attachment, as described, which is capable of attachment to a trigger-operated hand tool. Again, a unique and significant advantage of this invention is the provision of a resulting powered tool assembly which can be held in one hand and manipulated by an operator in substantially the same manner as the hand tool alone. This invention contemplates providing either the powered attachment alone for use with a hand tool, or the hand tool equipped with the attachment.

Further objects of the present invention and its features will suggest themselves to those skilled in the art upon a reading of the present specification, together with the drawings attached hereto wherein, throughout the several views shown for each respective embodiment similar reference characters denote similar elements.

BRIEF DESCRIPTION OF THE DRAWINGS

FIG. 12 is a right side elevational view of the trigger-guard housing shown in FIGS. 1 and 2;

FIG. 13 is a plan view of the housing of FIG. 12 showing its opened-up configuration when it is disassembled from the powered tool assembly;

DETAILED DESCRIPTION OF THE INVENTION

Figure 1:
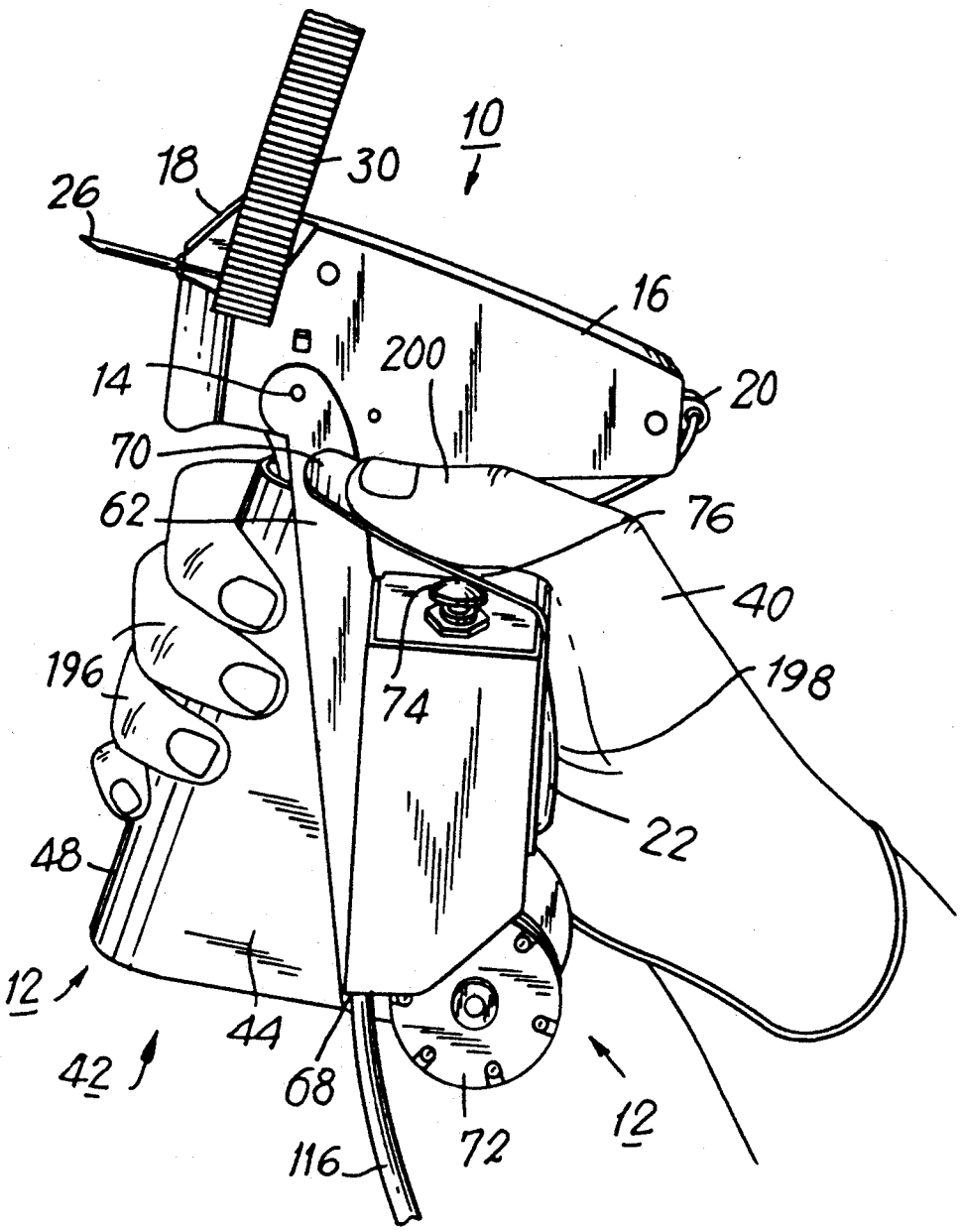
FIG. 1 is a left side elevation view of the hand of an operator holding a powered tagging assembly which includes a hand-holdable tagging tool mounted in or connected to a pneumatically driven powered actuator system according to one embodiment of the present invention.
Figure 2:
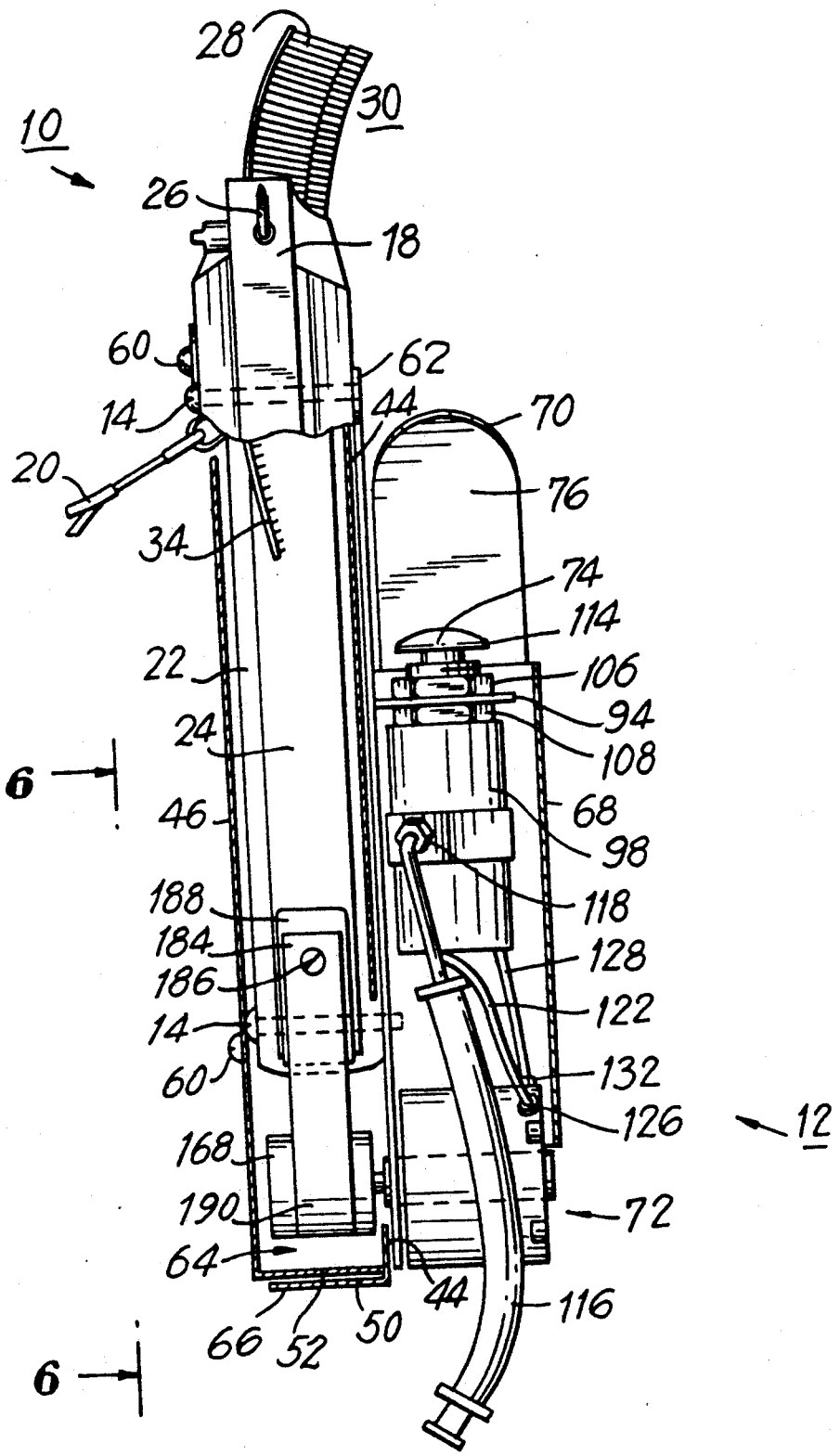
FIG. 2 is a front elevational view of the tagging assembly of FIG. 1 with a front-wall housing member broken away and a left-hand sidewall member partially broken away to display the internal design, and without the operator's hand being shown.

Referring now to FIGS. 1 and 2 of the drawings, the powered tagging assembly shown therein comprises a fastener-dispensing or tagging tool 10 firmly secured to a powered actuator system indicated generally at 12 by, amongst others, two transverse bolts 14.

The tagging tool 10 comprises a barrel-like body 16 carrying an operating head 18 at its forward end, a wrist band 20 at its rearward end and a relatively bulky pistol-grip handle 22 depending from a mid-portion of the body 16. The handle 22 houses a trigger 24 articulated at its upper end to the body 16. Not shown are resilient means that are loadable by squeezing the trigger to provide the power to actuate the hand tool 10, which resilient means also returns the trigger 24 to its inoperative or rest position. These trigger movements will be clearer from a discussion of FIGS. 4 and 5, with which the power drive system of this invention is described.

The internal structure of tagging tool 10, alone or per se, is not illustrated in detail here because it is well known in the art. However, relevant features will be mentioned since it is the combination of tagging tool 10 and the attachment features of the present invention which yield a new product contemplated by the present invention. All directions refer more or less to the disposition shown in FIG. 1 where an operator is to be considered to be pointing the tool forwardly away from himself or herself.

Projecting forwardly from the operating head is a hollow, open-sided needle 26 along which are ejected fasteners 28 fed downwardly from a collected plurality or clip 30 and leaving a tailing 32 that emerges from the underside of the operating head 18 as the fasteners 28 are discharged. The wrist band 20 normally carries a safety cap (not shown) to cover the needle 26 when the tool 10 is not in use.

Figure 2A:
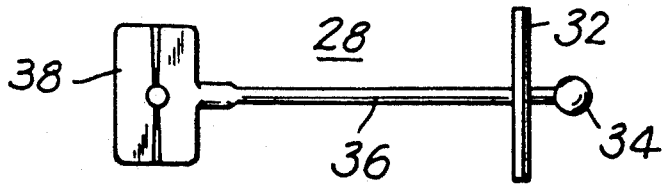
FIG. 2A is an enlarged plan view of a paddle-type tagging fastener shown in FIGS. 1 and 2.

As shown in FIG. 2A each fastener has a barb end 32 connected to a continuous tailing 34, a thin elongated shank 36 and an anchor 38. The fastener barb end 32 fits inside the hollow needle 26 along which it is driven by an internal mechanism normally powered by movement of the trigger 24. This driving action folds the elongated shank 36 down against the barb end 32 to form a barb substantially comparable to that found on a fishhook. In use, an operator holds the needle 26 through and against a label and, for example, a garment, and fires a fastener 28 through the label and garment. The anchor 38 holds the fastener against the label while the barb end 32 opens on the other side of the garment layer pierced so that the fastener 28 cannot be pulled back through the garment, with the result that the label is relatively securely attached to it.

The particular tagging tool 10 illustrated is of a type supplied by Dennison Manufacturing Co. of Framingham, Mass. under their trade names "Mark II Pistol-Grip Swiftacher". Some details of this and other tools, as well as details of a variety of fasteners are described in a product catalog identified by the legend "Dennison Swiftach Systems" on its front cover and by the reference "No. 815" on its back cover. This literature will be referred to herein as "the Dennison catalog".

The tagging tool 10 shown is relatively light in weight, being constructed primarily of molded plastic materials and weighing substantially no more than about seven or eight ounces. Low weight is important for easy maneuverability and reduced fatigue. Some models of tools which are able to be used with this invention are as light as three or four ounces.

In normal, hand-held operation of the tagging tool 10, the trigger 24 is squeezed against the handle 22 between an operator's fingers and his or her palm or the heel of his or her hand. In order to provide adequate driving forces for the fasteners 28 a substantial squeezing force is required—in the range of from four to eight pounds and typically about five or six pounds. Quite commonly, an operator tagging garments in a warehouse or factory is expected to apply a large number of tags, perhaps as many as fifteen or twenty per minute, all day, every working day. Unfortunately, this particular, repetitive action has an associated high probability of inducing a disabling condition known as carpal tunnel syndrome.

Repeatedly squeezing the trigger 24 presses the pistol-grip handle 22 into the heel of the operator's hand which is located directly above the carpal tunnel. The carpal tunnel is a passage between a rectangular-shaped ligament which goes across the heel of the palm and the bone at the back of the hand. The tendons from the thumb, the index and the middle finger, as well as some from the ring finger pass through this carpal tunnel. When the fingers are bent or flexed to squeeze the trigger 24, their ligaments move in the carpal tunnel so that pressure from the pistol-grip handle 24 on the carpal tunnel restricts movement of the ligaments in the carpal tunnel, creating hand stresses and fatigue for the operator. This pressure will eventually irritate or damage the ligaments and may produce a serious, disabling condition in which the operator no longer has sufficient use of his or her hand to operate the tool 10.

Some operators experience an irritation or pain in their shoulder simply from the continual physical effort of operating the tagging tool 10 frequently. This condition is aggravated when operators attempt to compensate for the pain associated with carpal tunnel syndrome, with a resulting debilitating effect.

To alleviate or eliminate these conditions, the present invention provides a novel and ingenious powered actuator system 12 which has been carefully designed so that the operator may hold and maneuver the powered tool assembly in his or her one hand 40 (FIG. 1), in much the same way as he or she holds and maneuvers the tool 10 by itself, and is relieved of the strain of squeezing a heavily loaded trigger by the provision of a lightly loaded switch controlling a powered trigger-actuating mechanism.

A number of factors contribute to the success of this construction and important amongst them are a trigger-guard housing indicated generally at 42 and a power system support frame member 62 which supports a power drive for the trigger and a switch to control it in a convenient and advantageous location. The frame member 62 further serves the function of attaching them to the tool and providing retaining means for the trigger guard housing 42. The function, structure and disposition of these components contribute to the achievement of the objectives of this invention.

Figure 4:
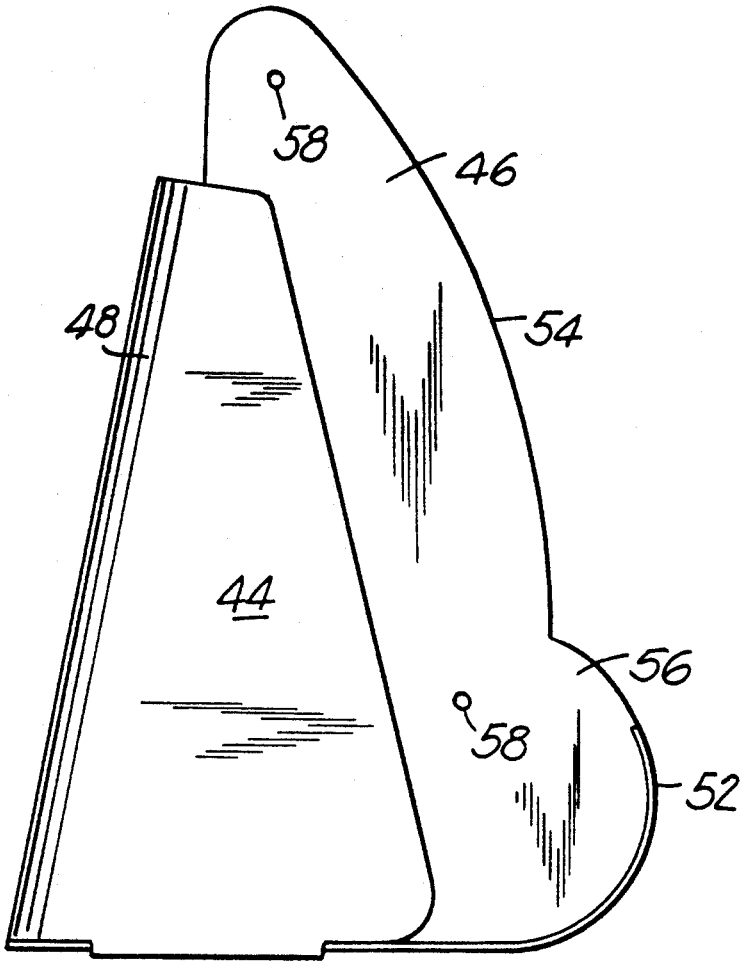
FIG. 4 is a side elevation of the trigger-guard housing shown in FIGS. 1 and 2.
Figure 5:
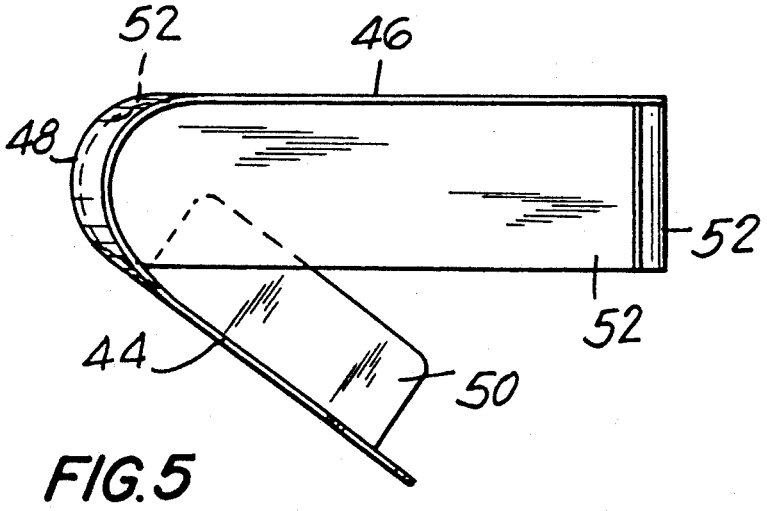
FIG. 5 is a plan view of the housing of FIG. 4 showing its opened-up configuration when it is disassembled from the powered tool assembly.

The construction of the trigger guard housing 42 is best understood from viewing FIGS. 4 and 5 in conjunction with this specification, while its assembly with the tagging tool 10 and the powered actuator system 12 may best be appreciated from FIGS. 1 and 2. The trigger guard housing 42 is preferably, but not necessarily formed from sheet metal, such as of a light, but sturdy thickness of a resilient aluminum alloy, although those skilled in the art will understand that other materials and manufacturing methods, for example injection molding of plastics materials, may be used. Similarly, while a right-handed version is illustrated and described, this embodiment of the invention contemplates a left-handed version as well.

The trigger guard housing 42 comprises generally flat right-hand and left-hand sidewall members 44 and 46 which are joined by a curved front wall member 48 (referring again to the operator's aspect in FIG. 1) and which include elongated bottom flanges 50 and 52. The left-hand sidewall member 44 has a quadrilateral shape tapering upwardly while the right-hand sidewall member 46 is generally triangular, also tapering upwardly, with a shoulder 54 curved convexly to follow the profile of tool handle 22; and has a segmented circular extension 56 to accommodate a pneumatic (air) drive rotary motor and a trigger drive mechanism being a component of power means for the powered actuator system 12. Bottom flange 52 extends upwardly around most of this extension 56, and the right-hand sidewall member 46 is provided with circular openings 58 for bolting it to the tagging tool 10. Left-hand sidewall member 44 carries an angled logo plate 60 or label which extends from its bottom flange 50.

The trigger guard housing 42, because of its tapered shape, has a decreasing cross-section from bottom to top so as to better fit snugly around tagging tool 10 at its upper end while accommodating a trigger drive mechanism at its lower end.

Because of its resilience, the trigger guard housing 42 opens up into a V-shaped configuration, in plan view, when it is dismantled from the powered actuator system 12 and this feature is useful in assembling the system 12 attachment to a tagging tool 10.

Left-hand sidewall member 44 is firmly secured to the tagging tool 10 by two sheet-metal screws 60 passing through openings 58 into holes drilled in the plastic material body 16 and handle 22 of the tagging tool 10. The trigger guard housing 42 extends around the front of the handle 22 substantially completely enclosing the trigger 24 and side wall member 44 fits snugly under a bracket-like frame member 62 where its resilience and particular configuration which stresses it against the securing screws 60, hold it firmly in place. Right-hand bottom flange 52 overlies left-hand bottom flange 50 and with the lower ends of the housing wall members 44, 46 and 48 provides a sturdy flat-bottomed box structure 64 under the tool handle 22 which provides a bearing surface 66 on which the whole assembly may be set and supported with or without the aid of a spring clip, bracket, suction cups or other support means (not shown). The box structure 64 accommodates a trigger drive mechanism to be described hereinbelow.

Powered actuator system 12 further comprises a pneumatic cylinder housing 68, a resilient switch lever 70, a cylindrical air motor 72 and an actuator valve 74. The pneumatic cylinder housing 68 is an open-ended, trough-like stamping also made from a resilient aluminum alloy which has three walls fitting comfortably around a pneumatic piston and cylinder and overlying the air motor 72 at its lower end. The resilient switch lever 70 comprises a forwardly angled pressure pad portion 76 overlying or abutting actuator valve 74 and a downwardly extending anchor plate portion (not shown) apertured to receive two securing bolts (not shown) passing through corresponding apertures into threaded openings in a bracket flange to be described. The switch lever 70 and the cylinder housing 68 are firmly secured in this manner. The pressure pad portion 76, if not the whole switch lever 70, is preferably formed of a pressed plastics material which is extruded to provide longitudinally oriented stress lines enhancing the resilience and durability of the switch lever 70. Further features of the switch lever 70 include its pressure pad portion having a substantial width comparable to the width of the average finger, i.e. from about ½ to 1 inch, for example (about ¾ inch), and a length of from 1 ½ to 2 ½ inches, for example (about 2 inches), and is smoothly finished to provide a comfortable device that can be used repeatedly for several hours at a time without irritation or stress. The disposition of the lever across the actuator valve 74, which is downwardly depressible against a resilient return, provides a mechanical advantage towards the free end of pressure pad portion 76, amplifying pressure applied in that area. The actuator valve 74 and the switch lever 70 are designed to have a comfortable feel and a positive response. Excess loading in these parts is undesirable, while inadequate resistance may causes inadvertent actuation, "misfires". An example of an effective loading of the actuator valve 74 with the construction depicted is from 8 to 16 ounces.

Figure 8:
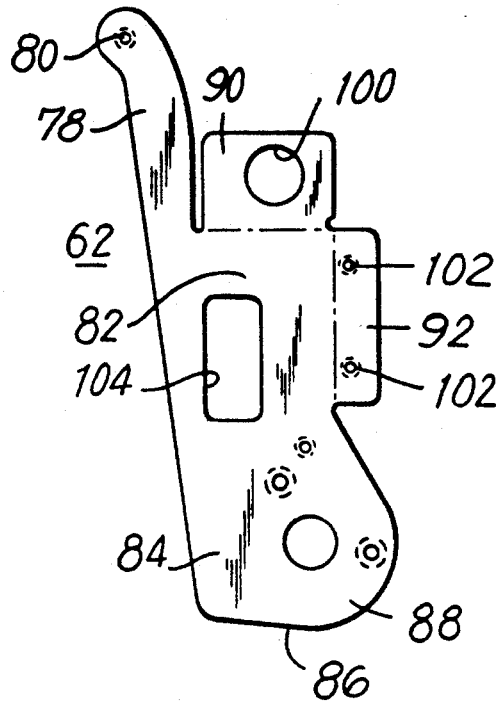
FIG. 8 is a plan view of a stamping for making a support frame being a component of the assembly shown in FIGS. 1 to 3.
Figure 9:
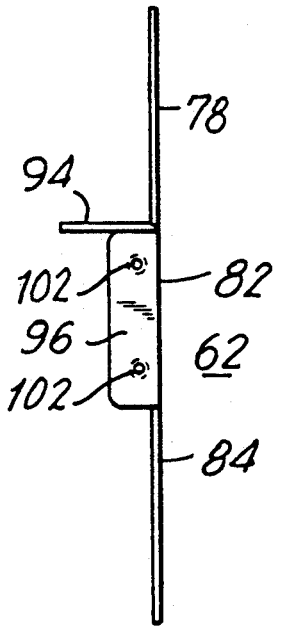
FIG. 9 is a rear (in the sense of FIG. 2) elevational view of the stamping of FIG. 8 bent into a support frame or bracket.

The structure of the frame member 62 may be seen from FIGS. 8 and 9. It is a rigid casting formed from chromed or stainless steel and including an upwardly extending arm portion 78 which is formed with a threaded aperture 80 at its extremity to receive an upper one of the transverse bolts 14 extending through the body 16 of the tagging tool 10, so as firmly to attach the frame member 62 thereto. The frame member 62 is further formed with a somewhat rectangular mid-portion 82 and a lower portion 84 which provides a flat base 86 and a curved hind sector 88. The mid-portion 82 has a pair of flaps 90 and 92 (FIG. 8) which are bent through 90 degrees to provide support brackets 94 and 96 (FIG. 9) for, respectively, a pneumatic piston and cylinder valve assembly 98, on which the actuator valve actuator 74 is mounted and for the screws (not shown) that hold the switch lever 70 in place. For these purposes, flap 90 has a substantial circular opening 100 to receive the piston and cylinder valve assembly 98 and flap 92 has two threaded openings 102. If desired, mid-portion 82 can have a cutout 104. Alternatively, frame member 62 could be fabricated from one or more stampings, and a variety of different structures is possible without departing from the spirit of this embodiment of the invention.

The structure of the trigger guard housing 42, and the manner in which it is firmly secured, cooperate to provide a sturdy housing substantially completely enclosing the tool handle 22 and trigger 24 while also accommodating major units of the powered actuator system 12 and providing convenient, comfortable gripping surfaces that enable the powered tool assembly, comprising the tagging tool 10 and the powered actuator system 12, to be held and maneuvered in one hand. The front wall member 48 and sidewall members 44 and 46, being mounted, as they are, to be substantially rigid, comprise a frame or shield which prevents the tool from being operated manually, unless, of course the assembly is dismantled.

Figure 3:
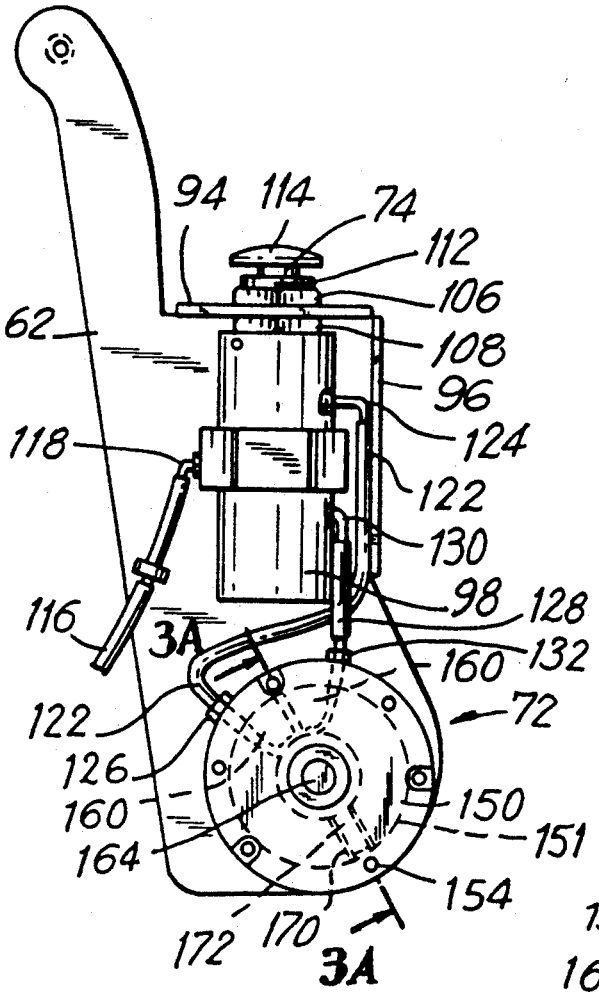
FIG. 3 is a right side elevational view of a pneumatic drive system being a sub-assembly of the powered actuator system shown in FIGS. 1 and 2.

As shown in FIGS. 2 and 3 a pneumatic piston and cylinder valve assembly 98 is supported on the left hand side of the powered tool assembly within the pneumatic cylinder housing 68 substantially opposite the palm of the operator's hand, by clamping nuts 106 and 108 and a locking (shakeproof) washer 110, on a threaded neck 112 which extends upwardly through the opening 100 in the support bracket 94 on frame member 62. The actuator valve 74 is a manually operated spring return four-way valve and is swaged into the neck 112 of the piston and cylinder assembly 98 and has a button 114 engageable by the switch lever 70, which button 114 is downwardly reciprocably depressible against a resilient return.

The powered actuator system 12 of this embodiment of the invention makes use of a pneumatic drive system which employs a compressed air supply controlled by trigger 24. The pneumatic drive system has two principal components namely the piston and cylinder valve assembly 98 responsive to the trigger, and what is referred to herein as air motor 72. The piston and cylinder assembly 98, works in conjunction with the actuator valve 74 (which is under the operator's control) and functions to admit air in predetermined controlled short bursts to the air motor 72 which, in turn, is powered by those air bursts and develops a reciprocable rotary mechanical output which, in turn, is transmitted from the trigger 24 by the mechanism shown in FIGS. 6 and 7.

Compressed air is supplied to the pneumatic piston and cylinder assembly 98 through a line 116 connectable to a compressed air supply attached to a connector 118 at the mid-point of one side of the piston and cylinder assembly 98 and is furnished with a standard Leuhr's connector 120 at its outer end. A short flexible air line 122 extends from a connector 124 on the other side of the piston and cylinder assembly 98 on an upper portion thereof down to a further connector 126 in an angularly offset position on the cylindrical air motor 72. A further air line 128 extends from a connector 130 on a lower portion of the other side of the piston and cylinder assembly 98 to a connector 132 on the top side of the air motor 72.

Figure 3A:
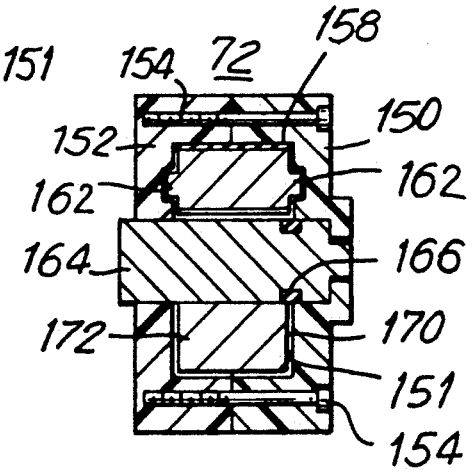
FIG. 3A is a section on the line 3A—3A of FIG. 3 of an air motor being a component of the pneumatic drive system of FIGS. 1 and 2, with some internal parts in an intermediate position.

As is best shown in FIG. 3A read in conjunction with FIGS. 2 and 3, the air motor 72 has a circular-cylindrical or drum-like housing with a hollow cylindrical interior chamber 151. The housing is formed by two dish-shaped injection-molded housing halves 150 and 152 secured together by transverse bolts 154. Connectors 126 and 132 open into the interior of the air motor 72 with small jet-like orifices, not shown, on either side of a valve member 156 which extends across the width of the chamber 151, carries a seal 158 around its center periphery and bears lobes 160 that overlie the orifices. The valve member 156 is located in circular recesses in housing halves 150 and 152 by end abutments 162. Journalled in the housing halves 150 and 152 is a transversely extending drive shaft 164 carrying a seal 166 at one end and, at its other end, externally beyond the air motor 72, a drive drum 168 positioned directly beneath the bottom of the handle 22. Within the interior chamber 151, the drive shaft carries a rotatable impeller 170 which has a sandwich-like construction, the filling of which is a soft, resilient blade 172 which is held between substantially rigid sidewalls and which sweeps the interior chamber 151 in close sealing engagement with the walls thereof. The impeller 170 is driven by predetermined controlled bursts of pressurized air between a near-vertical rest position lying against the valve member 156 at the air line connector 132, and an actuated position lying against the other side of valve member 156, about 270 degrees away from the rest position, at the air connector 126. The orifices emerging from the connectors 126 and 132 and the lobes 160 are designed to direct the air bursts to enhance the driving forces on the impeller 170. The interior chamber 151 is generously supplied with grease for lubrication and to condition the seal 166 and the resilient blade 172. The air motor 72 has a size and disposition such that its undersurface is substantially coplanar with the bearing surface 66 formed on the bottom of housing member 42, so as to help stabilize the entire assembly in a free-standing position.

The various air lines or hoses are preferably of high pressure polyurethane construction rated at up to 200 psi or equivalent. It is further capable of accepting a typical barb fastener which may be fired into the hose inadvertently or not, without necessarily puncturing.

Figure 6:
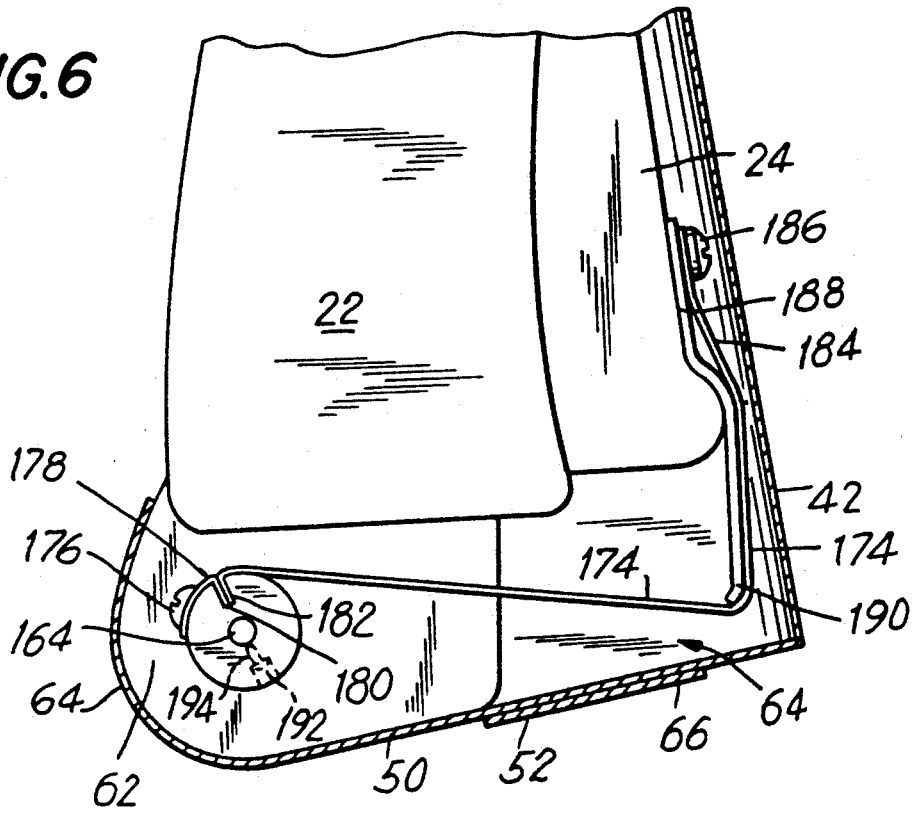
FIG. 6 is a schematic left-hand side elevation on the line 6—6 of FIG. 2 showing details of a trigger drive mechanism with the trigger released.
Figure 7:
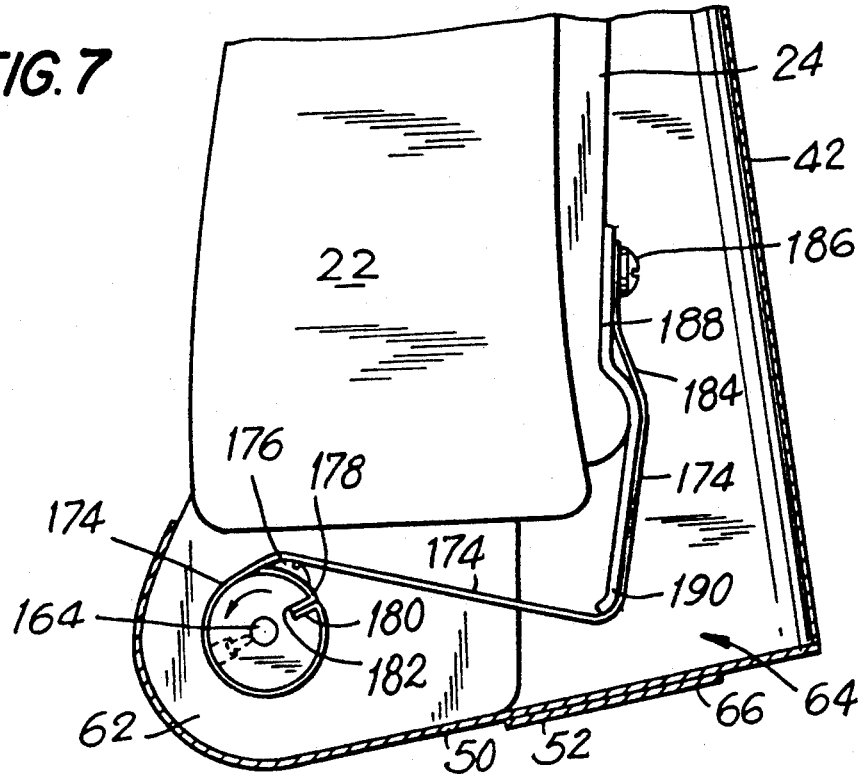
FIG. 7 is a view similar to FIG. 6 with the trigger depressed.

Referring now to FIGS. 6 and 7 read in conjunction with FIG. 2, the reciprocatory rotatable motion developed in the drive shaft 164 by the pneumatic drive system is transmitted to the trigger 24 by means of a trigger drive mechanism comprising the drive drum 168 and a drive ribbon tangentially secured thereto by a screw 176 and clamp plate 178, to be wound and unwound thereon, and which hold one end 180 of the drive ribbon 174 in a radial slot 182 in the drive drum 168. The opposite ribbon end 184 is secured by a sheet-metal screw 186 engaging a bore drilled in the plastic material body of trigger 24 and is positioned by a sheet-metal strip or guide plate 188 which is contoured to fit the bottom of the trigger 24 and which has a pendant guide tongue 190 which guides the ribbon 174 so that it is spaced below the trigger 24, thereby enhancing the leverage the ribbon 174 can exert on the trigger 24. The drive drum 168 is fixed to the drive shaft 164 by two screws 192 sunk in radial, countersunk shafts 194.

As labeled, FIG. 6 shows the trigger-drive system in a rest position where the trigger 24 is fully projected from the handle 22, and the ribbon 174 is turned at less than a right angle about the pendant tongue 190 to have good levering advantage and is wrapped through only a few degrees on the drive drum 168. In FIG. 7 the drive drum 168 has turned through about 270 degrees wrapping up the ribbon 174 for around three-quarters of a turn or more, and drawing the trigger 24 into the cooperative recess of handle 22 and actuating the tool mechanism. The resilient trigger return means in the tagging tool 10 pulls the ribbon back to the rest position of FIG. 6, and this return can be assisted or controlled by the air drive system, if desired and depending upon the specifics of its construction.

The complete trigger drive mechanism is contained within the box structure 64 beneath the handle 22 and trigger 24; which protects the operator from contact with moving parts and helps to balance the powered tool assembly by lowering its center of gravity.

The drive shaft 164 and drive drum 168 can be formed of any suitable material, but for durability, metal is preferred, and more preferable is a lightweight metallic alloy, but stainless or chromed steels are quite suitable. The ribbon 174 obviously requires high tensile strength and durability for which purpose woven synthetic resin fabrics are suitable such as, for example, woven nylon or polypropylene.

As is clearly shown in FIG. 1, the above-described powered actuator system 12 attachment, when assembled with a tagging tool 10, provides a compact structure which may readily be grasped by an operator who embraces the front wall member 48 of the trigger guard housing 42 with his or her four fingers, nestling the back of handle 22 in his or her palm 198, much where the unassembled tool handle 22 would fit, and resting the back of the tool body 16 on the top of his or her thumb 200, if desired.

A special advantage of this invention is that by virtue of the compact design of the trigger shield means and the way the power components are supported, rather than providing an extraneous handle, the operator is able to hold the powered tool assembly in substantially the same way as he or she does the manual tool so that it feels comfortable and familiar and he or she does not have to learn new operating techniques.

With the operator's other hand, which with the system of the present invention is free for the purpose, the operator is able to position a label in front of a product such as, for example, a garment and may easily depress the switch lever 70 to fire a fastener or barb through the label and into the garment where the barb opens attaching the label. More commonly, the label to be attached to the garment is first positioned with the needle through it, and thereafter the needle is positioned through the garment layer before firing. The construction of the switch lever 70 and the loading of the actuator valve 74 may be varied to suit an operator's needs or preferences, however the effort required to operate the tagging tool 10 is much less than the manual trigger loading being less than two pounds and typically a pound or a-pound-and-a-half or less so that it may be quickly and repeatedly operated for hours at a time with little or no stress on the carpal tunnel, which no longer has to bear the reaction of squeezing a heavily loaded trigger. Furthermore, the switch lever is advantageously positioned for actuation by the operator's thumb, which is sometimes stronger than the remaining fingers; but it could be disposed differently for operation by one of the remaining fingers without departing from the spirit of this embodiment of the invention.

Depressing the switch lever 70 moves the actuator valve 74 downwardly to admit air through the air line 116 to the piston and cylinder assembly 98 and to supply a burst of air to the air motor 72, driving the impeller 170 around the interior chamber 151 to its actuated position adjacent connector 126 and thereby turning the drive shaft 164 through approximately 270 degrees. This movement also turns the drive drum 168 mounted on the drive shaft 164 through a similar rotary distance, thereby winding up the ribbon 174 and thereby pulling the trigger 24 to actuate the tagging tool 10 and fire a barb or fastener through the label and into the garment. Resilient means in the tagging tool 10 and the piston and cylinder assembly 98 together with the return side of the compressed air system restore the powered tool assembly to its rest state, ready for another firing.

With the air line 116 coupled to a lightweight air-supply line the operator may easily manipulate the powered tagging assembly to any desired position and carry it to his or her work rather than vice versa. In particular, he or she can readily work through rows of hanging garments, attaching labels to their sleeves or neckbands, raising or lowering the tagging tool 10 as necessary. This is a great improvement over prior art methods which require either that the operator risk suffering carpal tunnel syndrome using a hand-operated tool or that the garments be taken to a tagging table and then re-hung, which is a slow, labor-intensive process.

Considering that the powered actuator system 12 can generate a loading of five or six pounds and apply it through more than an inch, it is a remarkably compact and lightweight system. The total weight of the system with a current model of the Dennison Mark II Pistol-Grip Swiftacher tool can be less than a pound and as low as ten (10) ounces, and still lower overall weights are possible utilizing the present invention. It should be appreciated that the small air power system of this invention can develop more than sufficient power for its intended uses, and its weight, substantially as described and shown, including all the components of the powered actuator system, may be as low as six or seven ounces with lower weights being possible. With selection of materials and components for minimum weight, weights as low as four ounces may be obtainable.

The actual volume of compressed air required is quite small. Using a supply at 50 lb. pressure of about a thirtieth of a cubic inch of air can be adequate to squeeze the trigger. A benefit of this small energy demand is that a single air compressor of only about one horsepower may drive as many as thirty or forty or even fifty powered tool assemblies according to the invention.

The powered actuator system of this invention in all the embodiments shown herein can be supplied with or without the hand tool with which it is designed to work and obviously the invention extends to the assembly of a hand tool with the powered actuator system described. It can also be supplied with or without compressed air means and, if supplied, this compressed air means can comprise a small portable air compressor of the type widely available for running off a car battery for individual use, or the more substantial compressor mentioned previously which is more suitable for commercial facilities. Many people and facilities have their own compressed air supplies in which case the system can be supplied with a simple quick-disconnect air-line fitting and the system of the invention is well adapted to run off typical commercial air supply systems with a minimum of adaptation normally requiring only a suitable air hose and connector. If desired, the system can also be supplied with extensive lengths of straight or coiled air hose. Also, the small air requirements of the system in such embodiment shown herein, which are in part attributable to careful and efficient design of the air motor and other pneumatic components, means that it can be run off a small compressed air cylinder, which may have particular advantage in remote locations.

By disposing the power means and the trigger drive system where they will be on the side of the handle 22 opposite the operator's palm, and beneath the handle, a particularly well-balanced powered tool assembly is realized, one which is appealing to hold. The main weight of the system is where it can easily be controlled with the center of gravity generally within or below the cup of the operator's hand. This is most advantageous for one-handed operation. One-handed operation is necessary in many operations including tagging so that the operator can manipulate the workpiece or other tool or material, with her other hand.

The trigger drive system comprising the flexible ribbon 174, the drive drum 168 and the guide piece 188 is an embodiment of a particularly advantageous and ingenious solution to the problem of providing a drive mechanism which can move the trigger 24 through an inch or more and give it a loading as high as ten pounds with normal air pressures of 50–60 psi (more with higher pressures) while being light in weight and readily disposed on a portable system in a compact manner. Wrapping the ribbon 174 on the drum 168 provides an excellent mechanical advantage and neatly stows the drive member, the ribbon, so that no additional space is needed to accommodate its back travel as might be the case with a rigid or linearly movable member. Furthermore, the ribbon, a somewhat critical component in whatever form it may be, is more likely to wear than other components, is economical and easy to replace, and indeed, a roll of ribbon can be supplied with the system, if desired. The invention is not however limited to this embodiment of trigger drive means which could take other forms such as, for example, a rotatable lever having a roller-equipped end engaging the trigger 24 the lever pivot point being towards the upper part of the handle 22.

The tagging tool 10 may in some instances be subject to abuse or substantial wear and tear in the hands of some powerful or over-enthusiastic operators, with consequent jamming or other failure of its components and shortened product life. Surprisingly, the system of this invention can extend the life of a hand tool used with it. By protecting the hand tool's trigger from manual operation, it cannot, with proper setting of the power system, be over-squeezed. Furthermore, the power system can be adjusted to operate the trigger with an optimal force continually and consistently and to drive it an optimal distance to prevent bottoming out, which wears parts. The piston and cylinder assembly 98 can be set so that the air flow is reversed or exhausted just before the piston bottoms out, and similarly, the various moving parts can be adjusted or chosen to avoid bottoming out or its equivalent. In particular, the diameter of the drive drum 168 can be chosen, or the throw of the rotatable impeller 170 may be adjusted, according to the tool with which the system is designed to be used to optimize the travel of the trigger 24.

Although particular reference has been made herein to a tagging tool or gun and its use for applying labels to garments, it will be clear to those skilled in the appropriate art that, while the invention provides in all of the embodiments shown herein a valuable solution to a specific problem in the garment industry, namely how to tag rows of garments with little risk of carpal tunnel syndrome, the principles of the invention can advantageously be applied not only to tag different products, such as fastening shoes together, but more importantly, they can be applied to quite different hand tools.

An example of another hand tool that could be powered with the system of the invention in the embodiments shown herein is a handheld stapler of the type used for construction projects which has a rectangular frame with an articulated handle that is squeezed towards the frame to eject a staple. In this event the trigger shielding means can extend around the handle and frame member and be secured to the frame. It might be noted that while powered staplers are widely available, they tend to be heavy and somewhat cumbersome, being unable to reach into corners as closely as the handheld type. The powered actuator system of the invention further provides an economical means of powering existing tools, i.e. retrofitting and offers the potential of interchangeability, with, if necessary, the trigger shield and housing means being adjustable or having interchangeable components to fit different tools.

Besides the pistol-grip type of tagging tool shown, all embodiments of the invention shown herein are equally well applicable to tools such as the first-shown Mark II Swiftacher tool in the Dennison catalog which has a scissor-like action. Because of its different disposition, the trigger drive mechanism would in this case be mounted behind the rear end of the tool rather than beneath it. The invention can also be used with tools carrying an extensive magazine of tags to avoid repeated reloading.

A left-handed version of the powered actuator system shown in FIGS. 1–9 can be provided by mounting the piston and cylinder assembly and air motor, with related components, on the other side of the housing and trigger shield, in other words, by generally reversing the disposition of the components.

Plainly the locations of the transverse bolts 14 and any other devices attached to the hand tool 10 are carefully chosen by examination and possibly dismantling of the tool, to ensure that they do not interfere with the proper working of the tool. The same considerations apply to the transverse bolt 218 and any other devices attached to hand tool 212 in the preferred embodiment of the invention shown in FIGS. 10– 17. Hand tool 212 accomplishes the same end tool work result as hand tool 10 shown in the embodiment of FIGS. 1–9.

The tagging tool 212 comprises a barrel-like body 214 carrying an operating head 222 at its forward end, a wrist band 220 at its rearward end and a relatively bulky pistol-grip handle 226 depending from a mid-portion of the body 214. The handle 224 houses a trigger 226 articulated at its upper end to the body 214. The handle 224 houses a trigger 226 articulated at its upper end to the body 214. Resilient means which are contacted by squeezing the trigger 226 provide the power to actuate the hand tool 212, which resilient means also return the trigger 28 to its inoperative or rest position.

As with tagging tool 10, attachment features of the present invention which yield the new and unobvious system contemplated by the present invention and the preferred embodiment will be discussed herein. In discussing the tool, all directions refer to the positioning shown in FIG. 1 where it can be assumed that the operator is pointing the tool forwardly away from himself or herself.

Projecting forwardly from the operating head 222 is a hollow, open-sided needle 228 along which fasteners 232 are ejected from a clip 234, or the equivalent leaving a tailing 236 that emerges from the underside of the operating head 222 as the fasteners 232 are discharged. The wrist band 220 normally carries a safety cap (not shown) to cover the needle 228 when the tool 212 is not in use.

In the preferred embodiment of this invention, a power actuated system 210 has been carefully designed such that an operator may hold and maneuver the powered tool assembly in either hand, (only right hand 244 shown in FIG. 10) in much the same way as he or she holds and maneuvers the tool 212 by itself, and is relieved of the strain of squeezing a heavily loaded trigger by the provision of an open ended pneumatic supply line terminating in a bleed port 246 in the system housing 216 such that simply putting an operator's finger over bleed port 246 causes a pneumatic fluid such as air to be redirected or conducted under pressure to an operating valve 238 which allows the air to operate a drive shaft 252 and a drum 254 connected thereto such that the drive shaft 252 and drum 254 are driven through equivalent rotary distances, thereby winding up a ribbon 256 which pulls the trigger 228 to actuate the tagging tool 10 and "fire" or eject a barb or fastener through the label and into the garment. A resilient means in the tagging tool 212 restores the powered tool assembly to its rest state, ready for another firing.

Figure 10:
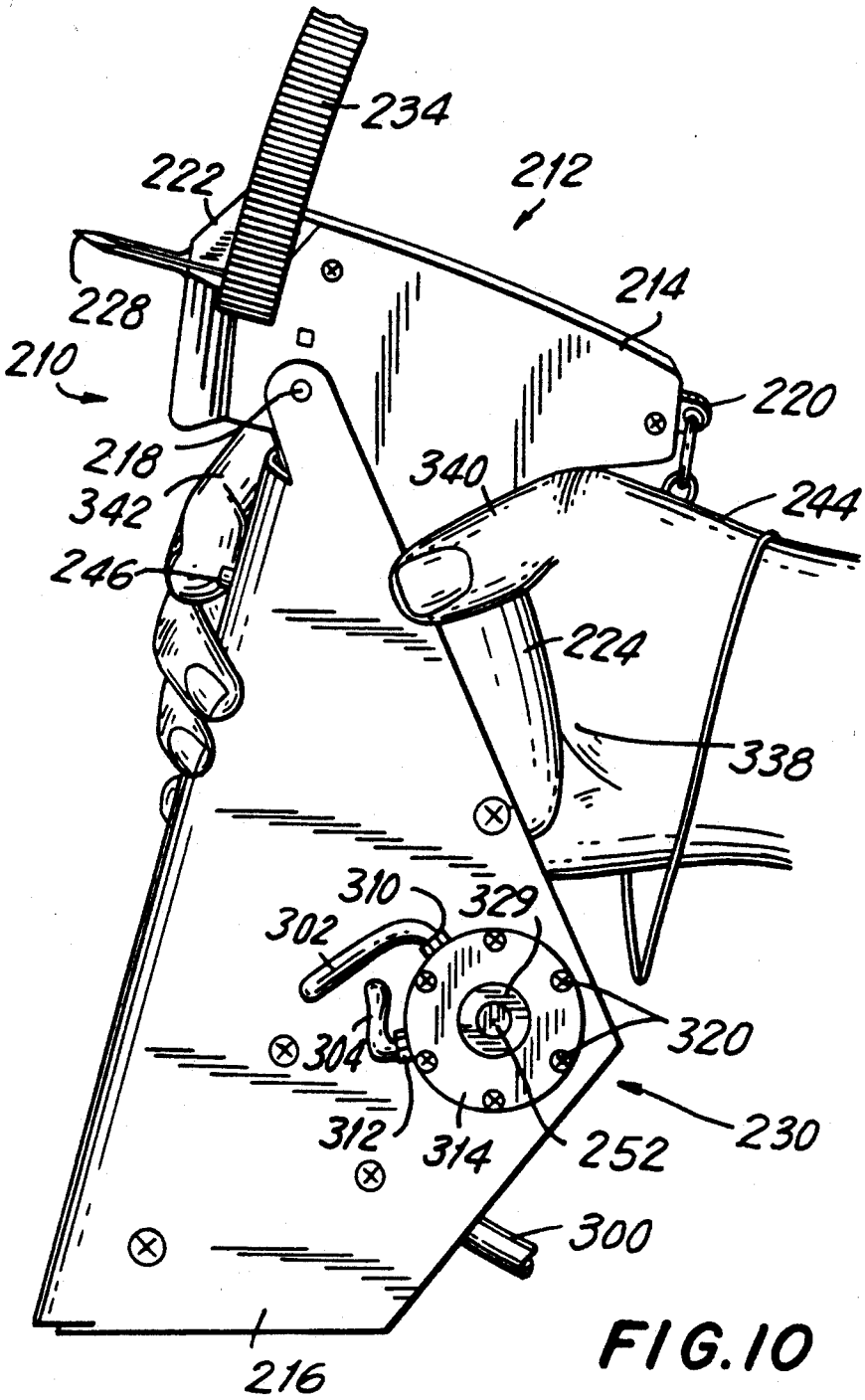
FIG. 10 is a left side elevational view of the hand of an operator holding a powered tagging assembly which includes a hand-holdable tagging tool mounted in or connected to a pneumatically powered actuator system according to the preferred embodiment of the present invention.
Figure 11:
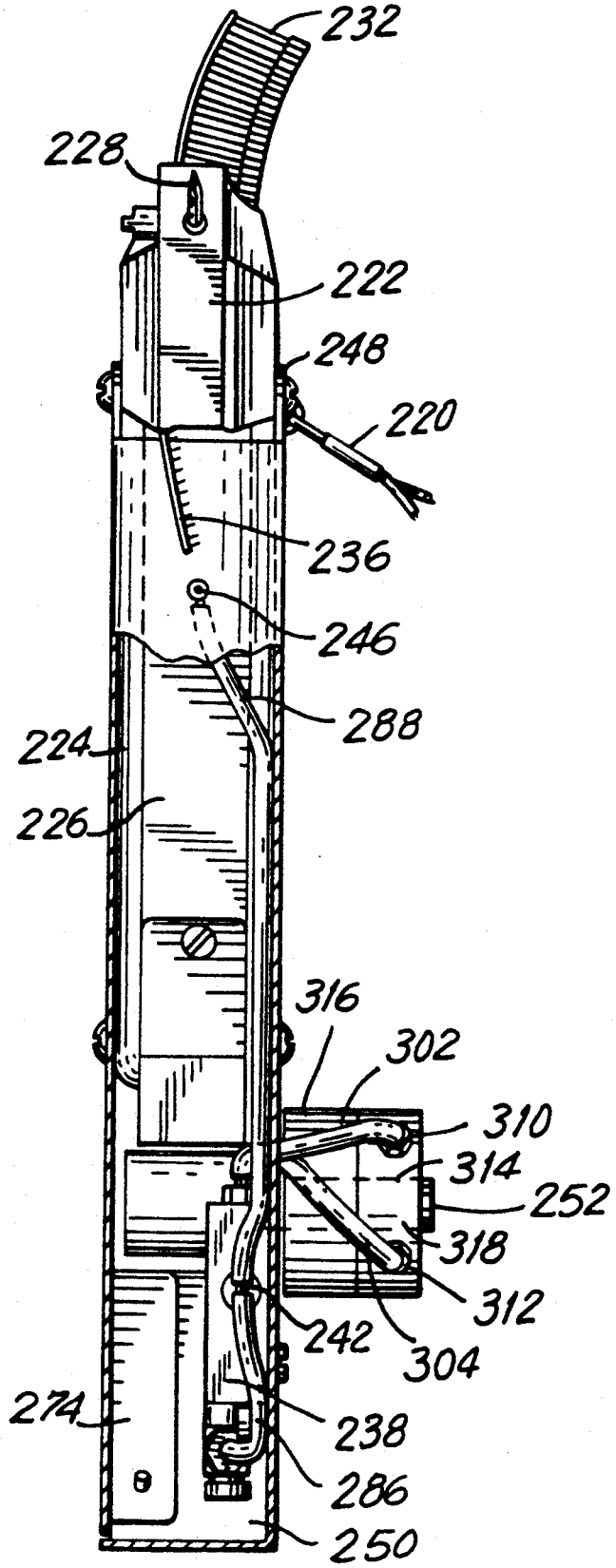
FIG. 11 is a front elevational view of the tagging assembly of FIG. 10 with a front wall housing member broken away and a left hand sidewall member partially broken away to display the internal design, and without the operator's hand being shown.

The construction of the trigger guard housing 216 is best shown in FIGS. 12 and 13, whereas its assembly with the tagging tool 212 and the powered actuator system 210 is best shown in FIGS. 10 and 11. The housing 216 is preferably, but not necessarily, formed from sheet metal such as a resilient aluminum alloy which can be given a thickness to make it both light and sturdy. Of course, those skilled in the art will recognize that other materials and manufacturing methods, for example, injection molding of plastic materials, can be used. In contrast to the previously described embodiment, this preferred embodiment can be used by either the right or left hand without modification.

The trigger guard housing 216 comprises generally flat right and left-hand side wall members 258 and 260 which are joined by a curved front wall member 262 (as seen from the operator's view in FIG. 1). Integral with left-hand side wall 260 are elongated bottom flange 264, side flange 266, which is adjacent to back flange 268, and spaced apart therefrom by a thin, elongated slit 270. Side flange 266 is spaced from bottom flange 264 by another slit 272 and is also integral with left-hand side wall 258. All three flanges 264, 266, and 268 are at obtuse angles relative to their respective adjacent flanges. Right-hand side wall member 258 also has an aperture 282 which corresponds to a hole extending through the body 214 of tagging gun 212 and enables it to be attached to the body by bolt 218 and a nut (not shown).

Both right-hand side wall member 258 and left-hand side wall member 260 of trigger guard housing 216 have a shape which tapers inwardly from their bases to their tops. Thus, the trigger guard housing 216, because of its tapered shape, has a decreasing cross-section from bottom to top so as to better fit snugly around tagging tool 212 at its upper end while accommodating a trigger drive mechanism at its lower end.

Because of its resilience, the trigger guard housing 216 opens up into a V-shaped configuration, in plan view as shown in FIG. 13, when it is dismantled from the powered actuator system 230. This feature is useful in assembling the system 230 attachment to a tagging tool 212.

When assembled to the tagging gun 212, the trigger guard housing 216 extends around the front of the handle 224 substantially completely enclosing the trigger 226. Right-hand side flange 274 overlies left-hand side flange 266 such that an aperture (not shown) in flange 274 overlies another aperture (not shown) in side flange 266 such that the right-hand side wall member 258 and the left-hand side wall member 266 can be incorporated in a unitary structure by the bolting of flanges 274 and 266 through the respective apertures therein. The result of joining the right-hand and left-hand side wall members 258, 260 together is to form, with the aid of bottom flange 264 a sturdy box-like structure 250 (FIG. 11) on which the old triggerless tagging assembly 210 may be set and supported with or without the aid of ring clips, brackets, suction cups or other support means (not shown). The box structure 250 accommodates a trigger drive mechanism to be described hereinafter.

Figure 14:
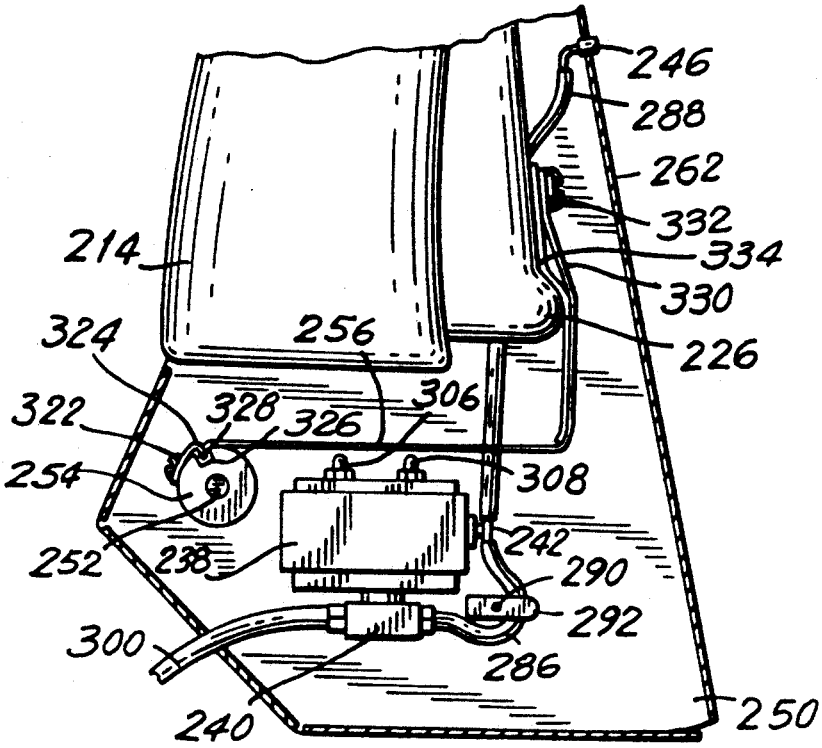
FIG. 14 is a right side sectional elevational view of the trigger drive mechanism of the preferred embodiment of FIG. 10 showing the trigger released.
Figure 15:
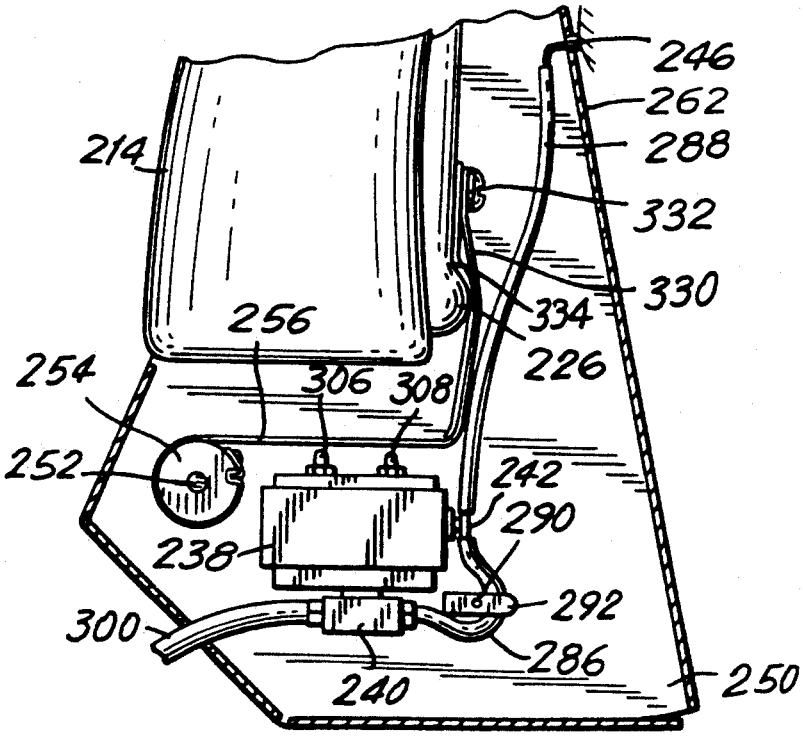
FIG. 15 is a view similar to FIG. 14 with the trigger depressed.
Figure 16:
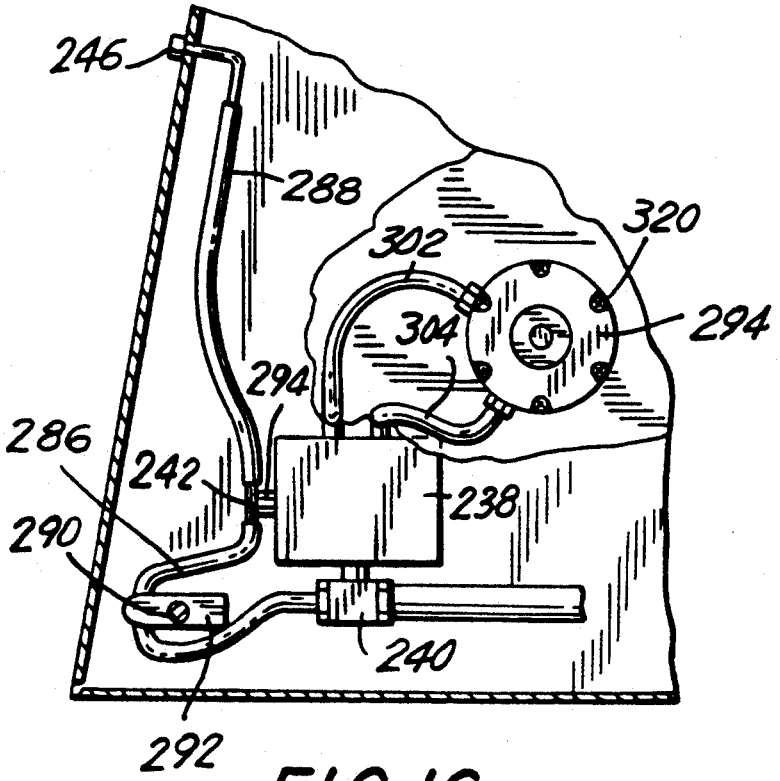
FIG. 16 is a left side elevational view, partly in section, of the pneumatic drive system of the preferred embodiment of the invention shown in FIG. 10.
Figure 17:
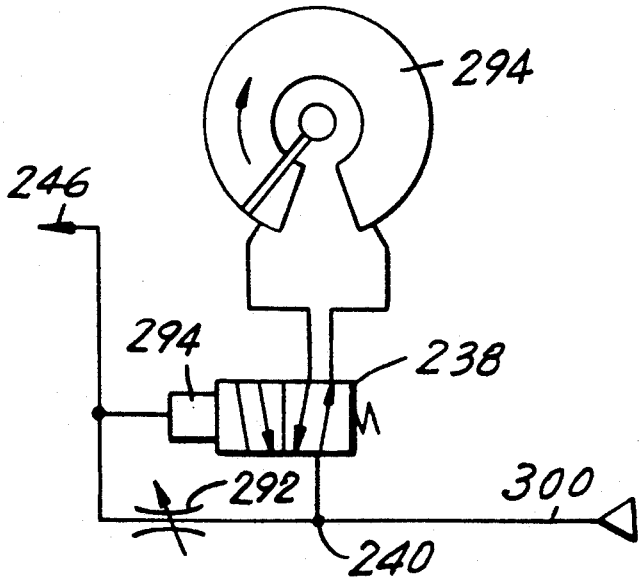
FIG. 17 is a schematic of the pneumatic drive system of the preferred embodiment of the invention shown in FIG. 10.

As shown in FIGS. 14–16, powered actuator system 230 further comprises an operating valve and a "Tee" type conduit fitting valve 240 connected to operating valve 238. A conduit 242 for a pneumatic fluid such as air extends from fitting 240 to bleed port 246 which can take the form of the aforementioned spool valve and which extends through front wall member 262 of trigger guard housing 216. When the gun 212 has its trigger in an inactivated position, a small predetermined flow of air is conducted from fitting 240 through conduit 242 and bleed port 246 to leave the assembly. Sections of external tubing 286, 288 surround air conduit 242 through most of its length and the flow of air through air conduit 242 can be regulated by tightening a screw 290 on clamp 292 which is attached to tubing section 286. By inhibiting or cutting off the flow of air through bleed port 246 by the user's simply placing his or her finger on or over all or a portion of bleed port 246, the operator can retard or stop the flow of air through conduit 242 and redirect some or all of it to valve controller 296 which moves from left to right (FIG. 17) to operate valve 238. Valve 238 in turn supplies a "blast" of air to rotary cylinder 294 which consequently rotates drive shaft 252 and the drive drum 254 surrounding it in a clockwise direction. As shown in FIG. 15, the drive drum 254 has been rotated through approximately 270 degrees, thus wrapping up the ribbon 256 for about three-quarters of a turn or more, and drawing the trigger 226 into the cooperative recess of handle 224 and actuating the tool mechanism. The resilient trigger return means in the tagging gun 212 pulls the ribbon 256 back to the rest position of FIG. 14. This return can be assisted or controlled by the air drive system, if desired, and depending upon the specifics of its construction.

Compressed air is supplied to the three-way valve 240 through a line 300 connectable to a compressed air supply. Two short flexible air lines 302, 304 extend respectively from connectors 306, 308 of operating valve 238 through left-side wall 260 of trigger guard housing 216 to respective connectors 310, 312, at angularly offset positions on rotary cylinder 294.

The rotary cylinder 294 shown in FIG. 11 has a circular-cylindrical or drum-like housing formed by two dish-shaped injection-molded housing halves 316 and 318 secured together by transverse bolts 320. Journalled in housing halves 316 and 318 is a transversely extending drive shaft 252 at its end within the trigger guard housing 216, drive drum 254. In similar manner to air motor 72 shown in the embodiment of FIGS. 1-9, drive shaft 252 of air motor 314 is driven by a predetermined operator controlled burst of pressurized air between a rest position and an actuated position, about 270 degrees away from the rest position. The orifices in the connectors 310 and 312 are designed to direct the air bursts to enhance the driving forces in the same manner as the impeller 170 of the embodiment of FIGS. 1-9 is driven.

As with the embodiment of FIGS. 1-9, the various air lines of hoses of the preferred embodiment of FIGS. 10-17 are preferably made of high pressure polyurethane rated at up to 200 psi or the equivalent. These air lines or hoses are further capable of accepting a typical barbed fastener which may be fired into the hose inadvertently without necessarily puncturing.

Referring now to FIGS. 14 and 15, read in conjunction with FIG. 11, the reciprocatory rotatable motion developed in the drive shaft 252 by the pneumatic drive system is transmitted to the trigger 226 by means of a trigger drive mechanism comprising the drive drum 254 and a drive ribbon 256 tangentially secured thereto by a screw 322 and clamp plate 324, to be wound and unwound thereon, and which hold one end 326 of the drive ribbon 256 in a radial slot 328 in the drive drum 254. The opposite ribbon end 330 is secured by a sheet-metal screw 332 engaging a bore drilled in the plastic material body of trigger 226 and is positioned by a sheet-metal strip or guide plate 334 which is contoured to fit the bottom of the trigger 226 and which has a pendant guide tongue 336 which guides the ribbon 256 s that it is spaced below the trigger 226, thereby enhancing the leverage the ribbon can exert on the trigger 226. The drive drum 254 is affixed to the drive shaft 252 by two screws (not shown) sunk in radial, countersunk shafts in drive drum 254.

As indicated heretofore, FIG. 14 shows the trigger-drive system in a rest position wherein the trigger 226 is fully projected from the handle 224, and the ribbon 256 is turned at less than a right angle about the pendant tongue 336 to have good levering advantage and is wrapped through only a few degrees on the drive drum 254. In FIG. 15 the drive drum 254 has been rotated through approximately 270 degrees, thus wrapping up the ribbon 256 for about three-quarters of a turn or more, and drawing the trigger 226 into the cooperative recess of handle 224 and actuating the tool mechanism. The resilient trigger return means in the tagging gun 212 pulls the ribbon 256 back to the rest position of FIG. 14. This return can be assisted or controlled by the air drive system, if desired, and depending upon the specifics of its construction.

The complete trigger drive mechanism is contained within the box structure 238 beneath the handle 226 and trigger 224. This arrangement protects the operator from contact with moving parts and helps to balance the powered tool assembly by lowering its center of gravity.

As with the embodiment of FIGS. 1-9, in the preferred embodiment shown in FIGS. 10-17, the drive shaft 252 and drive drum 254 can be formed of any suitable material, but for durability, metal is preferred, and more preferable is a lightweight metallic alloy. However, stainless or chrome steels are quite suitable. The ribbon 174 obviously requires high tensile strength and durability for which purpose woven synthetic rosin fabrics are suitable, such as, for example, woven nylon or polypropylene.

As is clearly shown in FIG. 10, and in similar manner to the other embodiment as shown in FIG. 1, the above-described powered actuator system 230 attachment, when assembled with a tagging tool 212, provides a compact structure which may readily be grasped by an operator who embraces the front wall member 262 of the trigger guard housing 216 with his or her forefingers, nestling the back of handle 22 in his or her palm 338, in approximately the same place where the unassembled tool handle 224 would fit, and resting the back of the tool body between his or her thumb 340 and the base of the index finger 342.

As with the embodiment of FIGS. 1-9, the preferred embodiment of FIGS. 10-17 eliminates, by virtue of the compact design of the trigger shield means and the way the power components are supported, the providing of an extraneous handle, such that the operator is able to hold the power tool assembly in essentially the same way as he or she does the manual tool so that it feels comfortable and familiar and he or she does not have to learn new operating techniques.

With the operator's other hand, which with the system of the present invention is free for the purpose, the operator is able to position a label in front of a product, such as, for example, a garment and can then use his or her index finger or any other finger to cover the bleed port 246 (FIG. 10) to fire a fastener or barb through the bleed port 246 bel and into the garment where the barb opens, thus attaching the label to the garment. More commonly, the label to be attached to the garment is first positioned with the needle through it, and thereafter the needle is positioned through the garment layer before firing. The construction of the bleed port 246, and the minimal amount of air passing therethrough from tubing 288 because of the clamping effect of screw 290 and clamp 292, make the effort required to operate the hand tool 212 minimal and much less even than the pound or pound and a half required by the embodiment of FIGS. 1-9. Thus, the trigger can be quickly and repeatedly operated for hours at a time with little or no stress on the carpal tunnel, which no longer has to withstand the stress of squeezing a heavily loaded trigger.

As with the embodiment of FIGS. 1-9, with the preferred embodiment of FIGS. 10-17, and with air line 300 coupled to a lightweight air-supply apparatus, the operator may easily manipulate the powered tagging assembly to any desired position and carry it to his or her work, rather than vice versa. In particular, he or she can readily work through rows of hanging garments, attaching labels to their sleeves or neckbands, and raising or lowering the tagging tool 12 as necessary. This is a great improvement over prior art methods which require either that the operator risk suffering carpal tunnel syndrome when using a hand-operated tool, or if a pneumatic tool is used, that the garments be taken to a tagging table and then rehung, a slow labor-intensive process.

Many of the other advantages heretofore described with respect to the embodiment of the invention shown in FIGS. 1-9 are applicable to the system 210 shown in FIGS. 10-17. These advantages include compactness and light weight, wherein the total weight of the system with a current model of the Dennison Mark II Pistol-Grip Swiftacher Tool can be less than a pound. Also, the actual volume of compressed air required is quite small. Using a supply at 50 pounds pressure with about a thirtieth of a cubic inch of air is adequate to squeeze the trigger. The benefit of this small energy demand is that a single air compressor of only about one horsepower may drive as many as fifty powered tool assemblies.

As with the powered actuator 12 heretofore described with respect to FIGS. 1–9, the powered actuator system 210 of the preferred embodiment of this invention can be supplied with or without the hand tool with which it is designed to work. Thus, obviously, the invention extends to the assembly of a hand tool with the powered actuator system. It can also be supplied with or without compressed air means and, if supplied, the compressed air means can comprise a small portable compressor of the type widely available for being powered by a car battery for individual use. Otherwise, as mentioned previously, a more substantial compressor can be used for commercial facilities. For people and facilities with their own compressed air supplies, the system can be supplied with assembled quick-disconnect air line fitting. The system of the invention is thus well adapted to run from typical commercial air supply systems with a minimum of adaptation, normally requiring only a suitable air hose and connector. If desired, the system can also be supplied with extensive lengths of straight or coiled air hose. Also, the small air requirements of the system, which are in part attributable to careful and efficient design of the air motor and other pneumatic components, allow it to be run from a small compressed air cylinder, which may be particularly advantageous in remote locations.

A distinct advantage of the preferred embodiment of the invention described heretofore in FIGS. 10–17 is that the disposition of the power means and the trigger drive system beneath the handle 226 results in a particularly well-balanced powered tool assembly, which is easy to hold with either hand. The main weight to the system is where it can easily be controlled with the center of gravity generally within or below the cup of the operator's hand. This is most advantageous for one-handed operation such as is necessary in many operations including tagging so that the operator can manipulate the workpiece or other tool or material with their other hand.

The trigger drive system of the preferred embodiment shown in FIGS. 10–17, which comprises the flexible ribbon 256, the drive drum 254, and the guide member 330 is an embodiment of particularly advantageous and ingenious construction which solves the problem of providing a drive mechanism which can move the trigger 226 through an inch or more and give it a loading as high ten pounds with normal air pressures of 50–60 psi (more with higher pressures) while being light in weight and readily disposed on a portable system in a compact manner. Wrapping the ribbon 256 on the drum 254 provides an excellent mechanical levering advantage and neatly stows the drive member, i.e., the ribbon, so that no additional space is needed to accommodate its backward travel as might be the case with a rigid or linearly movable member. Furthermore, the ribbon, a somewhat critical component in whatever form it may take, is more susceptible to wear than other components, but is economical and easy to replace and, indeed, a roll of ribbon can be supplied with the system if desired. As mentioned heretofore with respect to the embodiment of FIGS. 1–9, the invention is not limited to this embodiment of trigger drive means and could use trigger drive means in other forms such as, for example, a rotatable lever having a roller-equipped end engaging the trigger 226 with the lever pivot point being towards the upper part of the handle 224.

As with the embodiment of FIGS. 1–9, the system 210 described in FIGS. 10–17 can extend the life of a hand tool used with it by protecting the hand tool's trigger from manual operation, and thus preventing it from being over-squeezed. Furthermore, the powered system can be adjusted to operate the trigger with an optimal force continually and consistently and to drive it an optimal distance to prevent its bottoming out, a cause of wear of the parts. More specifically, the various moving parts can be adjusted or chosen to avoid bottoming out or its equivalent. In particular, the diameter of the drive drum 254 can be chosen according to the tool with which the system is being used to optimize the travel of the trigger 226.

As mentioned previously, the invention and all of its embodiments can be used for other applications, e..g., fastening shoes together, and more importantly, the powered actuator system 230 of the invention can be applied to quite different hand tools. Such a hand tool might be a hand-held stapler of the type used for a construction project which has a rectangular frame with an articulated handle that is squeezed towards the frame to eject a staple. As mentioned previously, in this event the trigger shielding means can extend around the handle and frame member and be secured to the frame.

Also as mentioned previously, besides the pistol-grip type of tagging tool shown, all of the embodiments of the invention shown herein are equally well applicable to tools such as the Mark II Swiftacher Tool in the Dennison catalog which has a scissor-like action. Because of its different disposition, the trigger mechanism would in this case be mounted behind the rear end of the tool rather than beneath it. The invention can also be used with tools carrying an extensive magazine of tags to avoid repeated reloading.

As mentioned previously, a salient feature of the powered actuator system shown in FIGS. 10–17 is that it can be used by either the right hand or the left hand without any need for reversing the disposition of any components.

The embodiments of the invention disclosed in the present specification and drawings and claims are presented merely as examples of the invention. Other embodiments, forms, or modifications thereof will readily suggest themselves and are contemplated as coming within the scope of the present invention.

What is claimed is:

1. A powered actuator system for use with existing tagging guns having user-operated trigger actuating members, or the like, comprising, in combination:

a housing formed with means for attachment thereof to such a tagging gun;

an actuating assembly including a chamber formed therein and a valve member movably disposed within said chamber, said valve member being movably responsive to remote induced pneumatic forces;

a pneumatic motor assembly integral with said housing, said pneumatic motor assembly including a drive shaft, said pneumatic motor including said drive shaft being operably responsive to movement of said valve member;

conduit means operably communicating with said actuating assembly for conveying pneumatic fluid forces to same;

means for transferring forces from said drive shaft to a tagging gun trigger actuating member; and said housing having an aperture therein situated such that an open end of said conduit means is connected thereto and such that covering said open end by movement of a single finger of a user without moving muscles which would otherwise induce carpal tunnel syndrome, said covering of said open end in response to said finger movement enabling operation of said valve, thus enabling induced pneumatic forces to move said valve member, thereby causing movement of the tagging handgun trigger actuating member in an actuating direction, resulting in ejection of a fastener from the handgun, wherein said means for transferring forces comprises a drive drum mounted on said drive shaft, and said trigger actuating member being attached to said drive drum such that rotational movement of said drive shaft rotates said drive drum and causes said trigger actuating member to operate said trigger and wherein said trigger actuating member is a drive ribbon which is wound up by rotation of said drive drum so as to operate said trigger.

2. A powered actuator system for use with existing tagging guns having user-operated actuating members, or the like, comprising, in combination:

a housing;

said housing formed with means for attachment thereof to such a tagging handgun;

an actuating assembly including a tagging gun trigger member;

a pneumatic motor assembly integral with said housing;

conduit means operably communicating with said actuating assembly for conveying pneumatic fluid thereto;

means for transferring forces from said pneumatic motor assembly to said tagging gun trigger actuating member; and said housing having an aperture therein situated such that an open end of said conduit means is connected thereto, and such that covering said open end by movement of a single finger of a user without moving muscles which would otherwise induce carpal tunnel syndrome, said covering of said aperture in response to said finger movement enabling operation of said valve, thus enabling induced pneumatic forces to cause movement of said tagging gun trigger actuating member in an actuating direction, resulting in ejection of a fastener from the gun, said tagging gun trigger actuating member comprising a drive ribbon capable of being wound up to operate said trigger actuating means.

3. A powered actuator system for use with existing tagging guns having user-operated trigger actuating members, or the like, comprising, in combination:

a housing;

said housing formed with means for attachment thereof to such a tagging gun;

an actuating assembly including a chamber formed therein and a valve member movably disposed within said chamber, said valve member being moveably responsive to remote induced pneumatic forces;

a pneumatic motor assembly comprising a motor housing forming an interior chamber therein, an impeller mounted within said motor housing, said motor housing having an opening and an external conduit connected to said opening and to said chamber, such that air from said chamber enters said motor housing through said opening and moves said impeller which in turn rotates said drive shaft;

means for transferring forces from said drive shaft to a tagging gun trigger actuating member; and said housing having an aperture therein situated such that an open end of said conduit means is connected thereto, and such that covering said open end by movement of a single finger of a user without moving muscles which would otherwise induce carpal tunnel syndrome, said covering of said aperture in response to said finger movement enabling operation of said valve, thus enabling induced pneumatic forces to move said valve member, thereby causing movement of the tagging gun trigger actuating member in an actuating direction, resulting in ejection of a fastener from the handgun.

4. A powered actuator system for an actuating means operated tool, said tool having a pivotable actuating means operable by a closing of an operator's hand, an attachment to said hand tool for rendering the closing of the operator's hand unnecessary and comprising, in combination:

a housing said housing formed with means for attachment thereof to such an actuating means-operated hand tool;

an actuator means for operating a trigger of the hand tool and enabling a resilient return thereof, said actuator means comprising a drive ribbon capable of being wound up to operate said trigger actuating member;

power means comprising a motor connectable to a power supply to power said actuator means;

a conduit having an open end for controlling actuation of the power means; and wherein said housing provides grip means for an operator to hold and operate an assembly of said power actuated system and an associated hand tool in either hand and wherein said conduit is disposed such that a finger can be repeatedly placed over said open end to respectively repeatedly actuate said power means.

5. A powered actuator system for use with existing tagging guns having user-operated trigger actuating members, or the like, comprising, in combination:

a housing formed with means for attachment thereof to such a tagging gun;

an actuating assembly including a chamber formed therein and a valve member movably disposed within said chamber, said valve member being movably responsive to remote induced pneumatic forces;

a pneumatic motor assembly integral with said housing, said pneumatic motor assembly including a drive shaft, said pneumatic motor including said drive shaft being operably responsive to movement of said valve member;

conduit means operably communicating with said actuating assembly for conveying pneumatic fluid forces to same;

means for transferring forces from said drive shaft to a tagging gun trigger actuating member; and said housing having an aperture therein situated such that an open end of said conduit means is connected thereto and such that covering said open end by movement of a single finger of a user without moving muscles which would otherwise induce carpal tunnel syndrome, said covering of said open end in response to said finger movement enabling operation of said valve, thus enabling induced pneumatic forces to move said valve member, thereby causing movement of the tagging handgun trigger actuating member in an actuating direction, resulting in ejection of a fastener for the handgun; wherein said pneumatic motor comprises a motor housing forming an interior chamber therein, an impeller mounted within said motor housing, said motor housing having an opening and an external conduit connected to said opening and to said chamber, such that air from said chamber enters said motor housing through said opening and moves said impeller which in turn rotates said drive shaft.

6. The powered actuator system of claim 5, wherein said means for transferring forces comprises a drive drum mounted on said drive shaft, and said trigger actuating member being attached to said drive drum such that rotational movement of said drive shaft rotates said drive drum and causes said trigger actuating member to operate said trigger.

7. The powered actuator system of claim 6, wherein said trigger actuating member is a drive ribbon which is wound up by rotation of said drive drum so as to operate said trigger.

8. The powered actuator system of claim 5, further comprising a clamp attached to said conduit means, and a screw for adjusting said clamp to regulate the flow of pneumatic fluid through said conduit means.

9. The powered actuator system of claim 5, wherein said conduit means has a narrower portion within said housing adjacent to said aperture.

10. The powered actuator system of claim 9, wherein said narrower portion extends through said aperture and terminates in a bleed port outside of said housing.

11. A tool for use in a hand of a user, said tool comprising, in combination:

a housing, task means for performing a predetermined task by a user, said task means being supported by said housing, said task being performed upon actuation of task forces, fluid directing means for directing a first quantity of fluid through an actuator port accessible to a fluid flow obstructing member, and actuating means responsive to an actuating disposition of said fluid flow obstructing member for causing the performance of said task; and a clamp attached to said fluid directing means, and a screw for adjusting said clamp to regulate the flow of pneumatic fluid through said conduit means.

12. A powered actuator system for a user-operated hand tool, said tool having a pivotable trigger operable by a closing of an operator's hand, an attachment to said hand tool for rendering the closing of the operator's hand unnecessary and comprising, in combination:

a housing formed with means for attachment thereof to such a trigger-operated hand tool;

an actuator means for operating the trigger of the tool and enabling the resilient return thereof, said actuator means comprising a drive ribbon capable of being wound up to actuate said driving member;

power means comprising a motor connectable to a power supply to power said trigger actuator means;

a conduit having an open end for controlling actuation of the power means; and wherein said housing provides grip means for an operator to hold and operate an assembly of said power actuated system and an as associated tool in either hand and wherein said conduit is disposed such that a finger can be repeatedly placed over said open end to respectively repeatedly actuate said power means.

* * * * *